United States Patent [19]

Raymond et al.

[11] 4,264,927

[45] Apr. 28, 1981

[54] FREIGHT CAR IDENTIFICATION METHOD

[75] Inventors: Andre Raymond, Laval; Philippe Rioux, Boucherville; Lorne O'Connor, Laval, all of Canada

[73] Assignee: American District Telegraph Company, Jersey City, N.J.

[21] Appl. No.: 43,662

[22] Filed: May 30, 1979

[51] Int. Cl.[3] ..... H04N 7/18

[52] U.S. Cl. ..... 358/108; 358/93

[58] Field of Search ..... 358/108, 93; 246/2 R; 340/146.3 K

[56] References Cited

U.S. PATENT DOCUMENTS

| | | | |
|---|---|---|---|
| 2,956,117 | 10/1960 | Ernst | 358/108 |
| 3,238,358 | 3/1966 | Read . | |
| 4,161,000 | 7/1979 | Cleveland | 358/108 |

OTHER PUBLICATIONS

"Instar-A Revolutionary Motion Analysis System" Oct. 1976-seven pages.

Video Masters, Inc. "Price Lists-Sep. 1, 1977", fourteen pages.

*Progressive Railroading*, Apr. 1978 pp. 58-59, "Union Pacific Combines TV and Videotape".

*Security Distributing and Marketing*, Mar. 1978 pp. 58-60, "Competing Against the Low Bidders".

*Machine Design*, Oct. 21, 1976 pp. 3-6, "Instant Replay in the Product Development Lab".

*Textile Industries*, Aug. 1974, unnumbered pages, "Photo Finish for High-Speed Warp Knitting".

*Primary Examiner*—Howard W. Britton

*Attorney, Agent, or Firm*—Stephen P. Gilbert

[57] ABSTRACT

Method and apparatus are disclosed for optically scanning and recording information on railroad cars moving at high speed to facilitate identification of the cars.

30 Claims, 36 Drawing Figures

Supply + Deflection Board
Remove Q2 2N4945
270K 1/4W 5%
Target Pot. R5 Replaced By 270K-1/4W-5%
1Q6
1R16 Fil. Set
1Q16
1P4
1J2'
1P2'
WHT
BLK
GRN
RED
R3 3K3
R4 2K2
C1 100K
R5 1K
R1 1K8
Q1 2N3906
R2 2K2
D1 1N914
-12V
+12V
C-1005
Vert Drive From 4P1 Pin1
6J2
V10
+12V GRN. To Lens YEL.
Video To Lens
JCT R79-R142
Tach Pulse
LED Supply
J1
P1
ORA.
YEL
GRN
Sampler Position Sensor TIL 139
ES1
4P1
WIDE H
HOR. DR
100 Ω 1/4W 5%
4Q8
560Ω
220 P
V.D.
Sync. Board
Sampler Motor M1
JM
A B C D E F H J K
YEL. BLK. GRA. RED A21
74LS93
MR
CP
+5V
R24 1K
680P C11
R25 1K
680P C12
R26 1K
C14 1K
R27 470Ω
R28 1K
470P C13
LED 2
TIL 209A
MOVE CANCEL
+5
C29-C31 10K
C34-C41
+12V
C28 33/16V
C26 10K
Z2
1N4744
+5V
C25 33/6.3V
C27 10K
Z3
1N4736
-12V
To Fig. 9A.
To Fig. 9C.

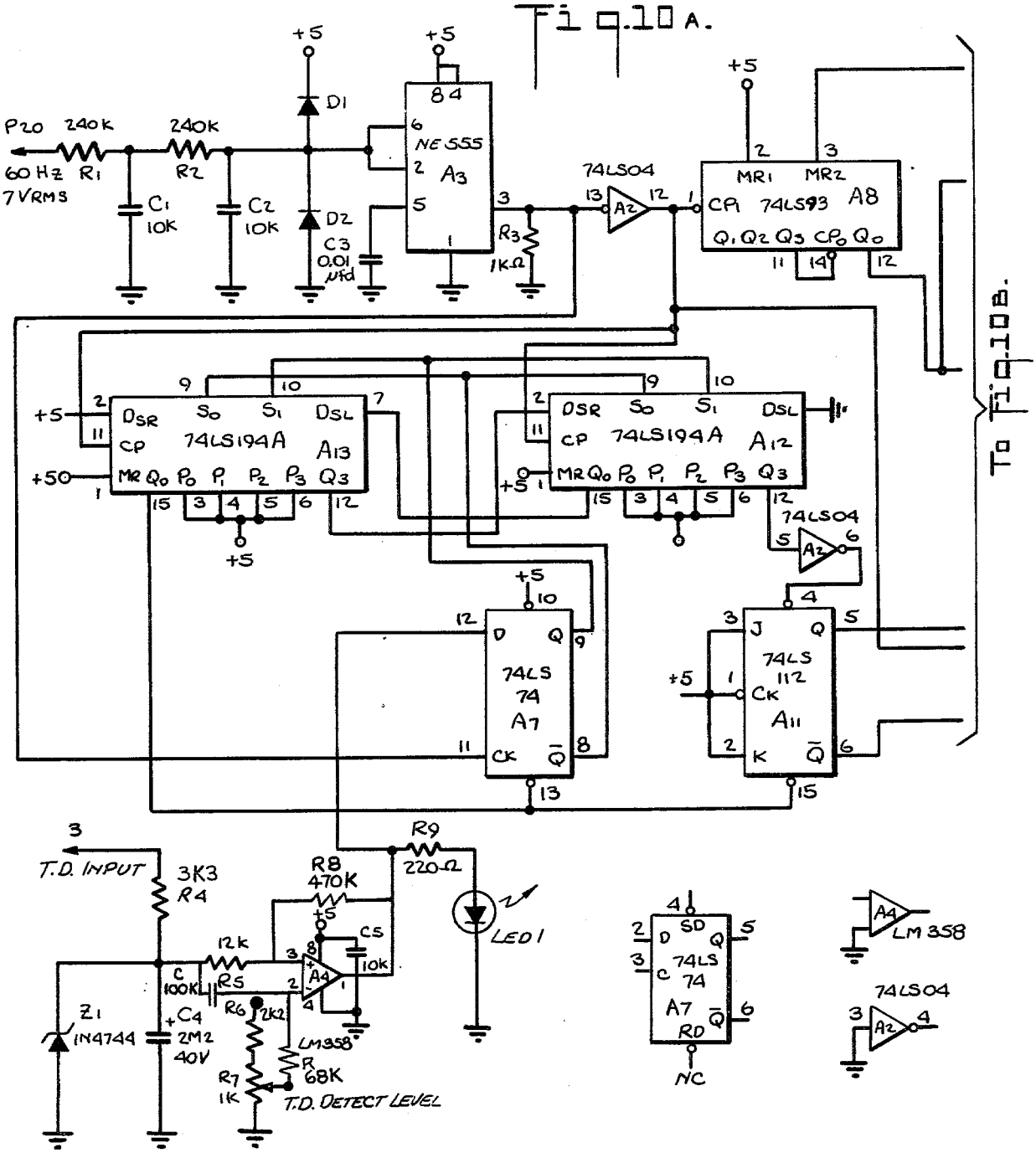
I.C. SUPPLY
14 PINS: COM-7, +5-14
16 PINS: COM-8, +5-16
74LS93: COM-10, +5-5
NE555: COM-4-8, +5-1
LM358: COM-4, +5
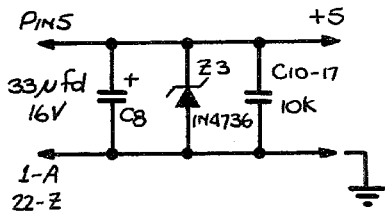

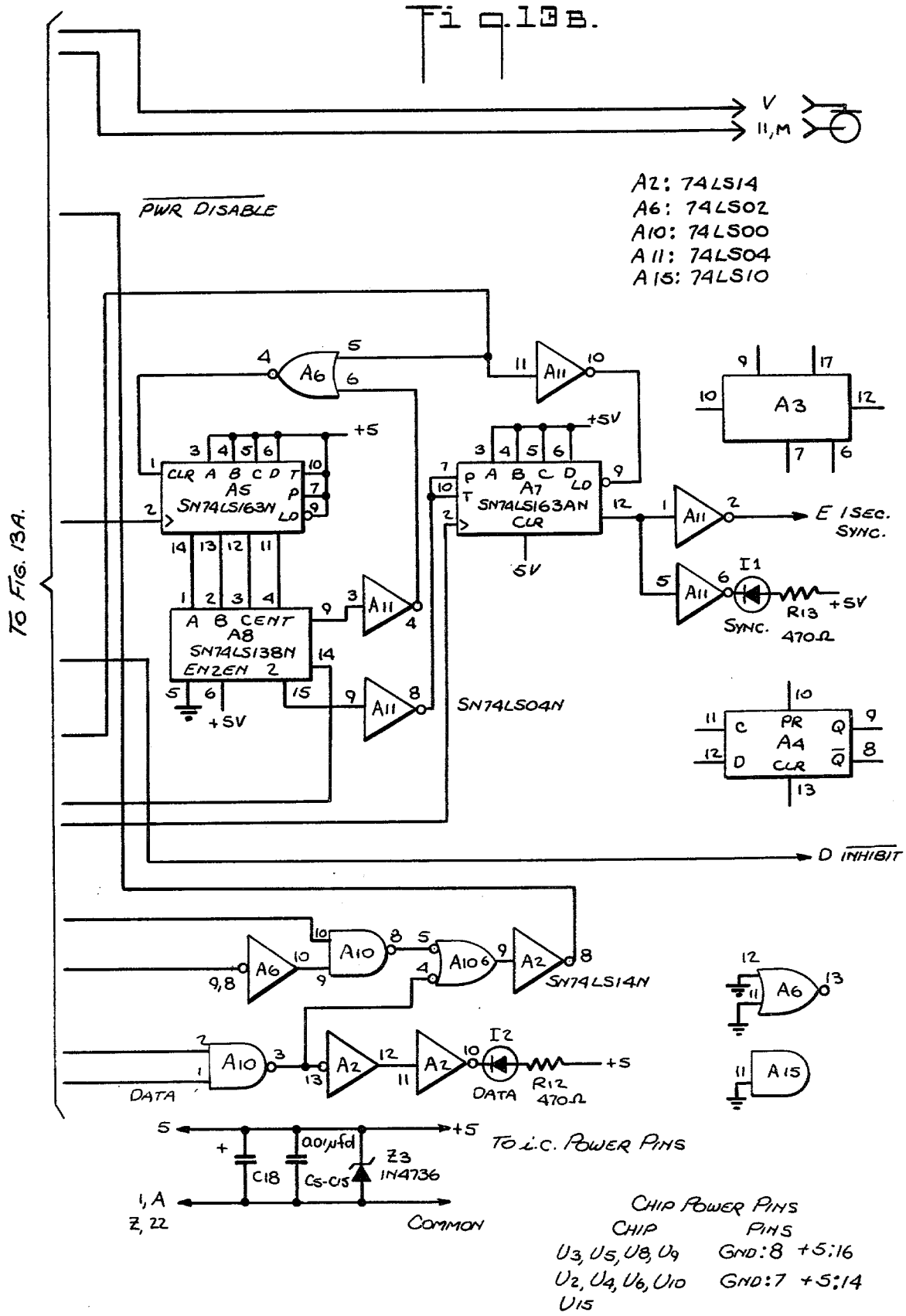
CHIP POWER PINS
| CHIP | PINS |
|---|---|
| U3, U5, U8, U9 | GND:8 +5:16 |
| U2, U4, U6, U10 U15 | GND:7 +5:14 |

X STROBE
X $\overline{\text{STROBE}}$
X DATA
A28
A7
R68 3K3
R67 1M
A1
311N-8
R66 2k
R65 10k
C50 680P
+2.28V
R62 3K3
R63 200Ω
+2.5V
C29 33/6V3
Q6 2N3904
Q5 2N3904
R61 470Ω
R57 820k
+2.3V
R58 1K
R59 2K2
R56 10K
C28 10K
C27 22k
Q4 2N3641
R54 2K7
R52 470Ω
R53 10K
COMPOSITE VIDEO
C25 10/25V
R64 15k
C31 1000P
2%
½ 74LS221 10MS STROBE
C30 680P
R60 1k
A13
½ 74LS221 25MS DELAY
R55 36k
C26 1000P 2%
TO FIG. 15D.

1 SEC PULSE
+5
10K R6
15K R7
A2 74LS 14
C2 1000pf
POR
CLK 1 LD
2 1 SEC
3 2 SEC
4 3 SEC
5 4 SEC
A20
CL A B C D
CP 74LS160 CED
PE QA QB QC QD CET
A17 74LS 32
PB
1V5
A19
A18 74LS 08
74LS 32 A14
74LS 11 A13
74LS 04 A7
C3 10K
R 74LS 279 A8
XMIT
+12
1N914
D1
555 A3
R11 560Ω 1/2W
OUT
Z1 1.5KE15
R12 1KΩ
TIL 209A
LED 1
TO FIG. 17A
420Nfd 25WVDC
R8 56KΩ C/R
5 SEC
A23
A24
D Q 74LS 74 CK CD
R9 56KΩ C/R
A22 74LS 10
COMMAND EXECUTE (P2)
R1 279 A8
PRESENCE (P2)
RECOR READY (P2)

ONE MOVE CANCEL
1 = CANCEL
0 = NORMAL
PRESENCE
0 = TRAIN
1 = NO TRAIN
MOTION
0 = MOTION
1 = NO MOTION
RECORDER RESET
BLINK
AUX
0 = OFF
1 = ON
TO LAMPS
PIN 12
1, A, 22, Z
ONE MOVE LAMP
MOVE END
MOVE END AUO
RECORDER RUN/OFF
TRACKSIDE RUN
SYSTEM RUN
RECORDER READY (A)
SYSTEM QUIESCENT (P1)
COMMAND EXEC (P1)
NO CONNECTION ON M, N, U
RECORDER RUN/STOP
80 ma AUX
14V 80 ma #330
14V 80 ma MOVE END
14V 80 ma

FREIGHT CAR IDENTIFICATION METHOD

BACKGROUND OF THE INVENTION

Railroads have long sought a rapid, economical, and reliable method for determining which cars are part of a moving train. Usually, this requires that the train be stopped or slowed to a speed of less than approximately 8 miles per hour so that a trainman may read the serial numbers on the sides of the cars (accuracy decreases significantly at higher speeds). Travel time is lost with this procedure, but the economic incentive to know the location of each car (e.g., demurrage) is great. Therefore, this inefficient method is still the customary one.

Numerous mechanical systems that claim high accuracy even with trains moving at speeds of 50 miles per hour or more have been proposed and at least several dozen patented. Most of these, however, require placement of special coded labels or equipment on each car. (See, for example, U.S. Pat. Nos. 3,106,706, 3,316,392, 3,377,616, and 4,002,889.) Various factors, including the high cost of installing and maintaining these labels or equipment, have, for the most part, prevented the railroads from using any of these systems. One of these systems was employed commercially, but was later abandoned for several reasons, including insufficient accuracy.

A system that does not require special labels or equipment on the cars is disclosed in U.S. Pat. No. 2,956,117. In accordance with that disclosure, a television camera at track-side is linked to a television receiver at a remote location (for example, at the train yard). The video signal received is recorded on film, which is then processed for later viewing. An optical system compensates for the low speed and resolution of the video tube (image orthicon or vidicon) employed. (An image orthicon has a 20 percent lag; a vidicon typically has a 40 percent lag, although it could be as low as 20 percent.) Special circuitry and equipment move the film during recording at a speed proportional to the train's velocity past the camera.

U.S. Pat. No. 3,238,358 discloses an identification system using coded labels on the axles of the cars, the labels being applied by special equipment. An operator located at a distance from the labeling equipment views the serial number on each car by means of television equipment so that he can encode the serial number. (See column 6, line 3 et seq.)

SUMMARY OF THE INVENTION

A new system that is completely automatic, has extremely high accuracy, and avoids the problems of the prior art systems has been developed. Special labels or devices on each car are not required, nor is there a wait for film to be developed. The new system enables an operator at a location remote from track-side to immediately (real-time) or later identify railroad cars with high accuracy even if the train was moving at speeds of 60 miles per hour or more.

Broadly, the present invention comprises a reading unit located at track-side that produces a video signal containing video information, means to record the video information, means to transmit the video information to the record means, means to playback the video information, and circuitry and other equipment to make the system fully automatic. The reading unit comprises (1) a television-type camera (color or black-and-white) having a pick-up device with high resolution and low lag and (2) an optical sampler (analogous to a stroboscopic system). Desirably, the camera is black-and-white and has a panchromatic spectral response, and more desirably, a panchromatic spectral response close to that of the human eye. Preferably, the pick-up device uses lead oxide (e.g., a Plumbicon) or is a silicon diode array or Newvicon or any other low-lag device, of which the first is most preferred. If one of the last three is employed, an infrared-cutting filter might be needed to bring the spectral response as close as possible to that of the human eye.

The preferred use of a black-and-white camera for this service is surprising in view of the following. In *Progressive Railroading*, April, 1979, page 58, it is stated that in a camera that shoots railroad cars, "color provides for greater fidelity."

Desirably, the record means can operate at any of several speeds, lower speeds being employed if the train is moving more slowly (for example, less than 8 miles per hour). This reduces the required amount of recording medium (for example, videotape). Naturally, the record means should record the video information with sufficient accuracy.

To enable the operator during playback to read the identifying data on the cars, the playback means should operate at a range of speeds and allow the operator to view a particular scene for an extended period without picture break-up. Such extended viewing might be required where adverse weather conditions or dirt partially obscured the identifying data on a car.

Usually, the recording medium will be videotape, and the same model videotape recorder although not necessarily the same machine, will be the record and playback means.

The transmission means used will generally depend upon the number of track-side locations within the system and the distance between the reading units and the recording means. Possible transmission means include base-band video, RF multiplexing, microwave, fiber optics, and optical links.

The circuitry and other equipment for making the system fully automatic include means to sense the approach of a train towards the track-side location and means to ready the system for recording after the approach is sensed. Other means preferably included are means to prolong equipment life when the system is not shooting a train (e.g., blanking the pick-up device, reducing current in heater filaments, and cutting high voltage in the pick-up device); means to illuminate a train at track-side when ambient light is insufficient; means to advise the operator at the remote location as to the operating status of the track-side equipment; and means to enable the operator to test the track-side equipment remotely. Other means preferably or optionally incuded will be described below.

DESCRIPTION OF THE DRAWINGS

In order to further illustrate the present invention, the following drawings are provided, in which.

DETAILED DESCRIPTION OF THE INVENTION

The present fully automatic system comprises equipment at one or more track-side locations and at a remote location. Equipment at track-side includes at least a reading unit (containing a camera) and usually includes presence and motion sensing equipment, lights, and a back-drop. The reading unit is normally installed within a housing for protection against the weather. Various electronic modules, connection boards, and a heater and air-conditioner are also usually located within the housing.

The remote location may be, for example, an office of a train-yard or a dispatcher's office. Equipment at the remote location includes at least one recording device. Desirably a video monitor and an operator control console are also present. Playback of the stored video information (and identification of the cars) may occur at the remote location or at another location having a playback unit.

Figure 1:
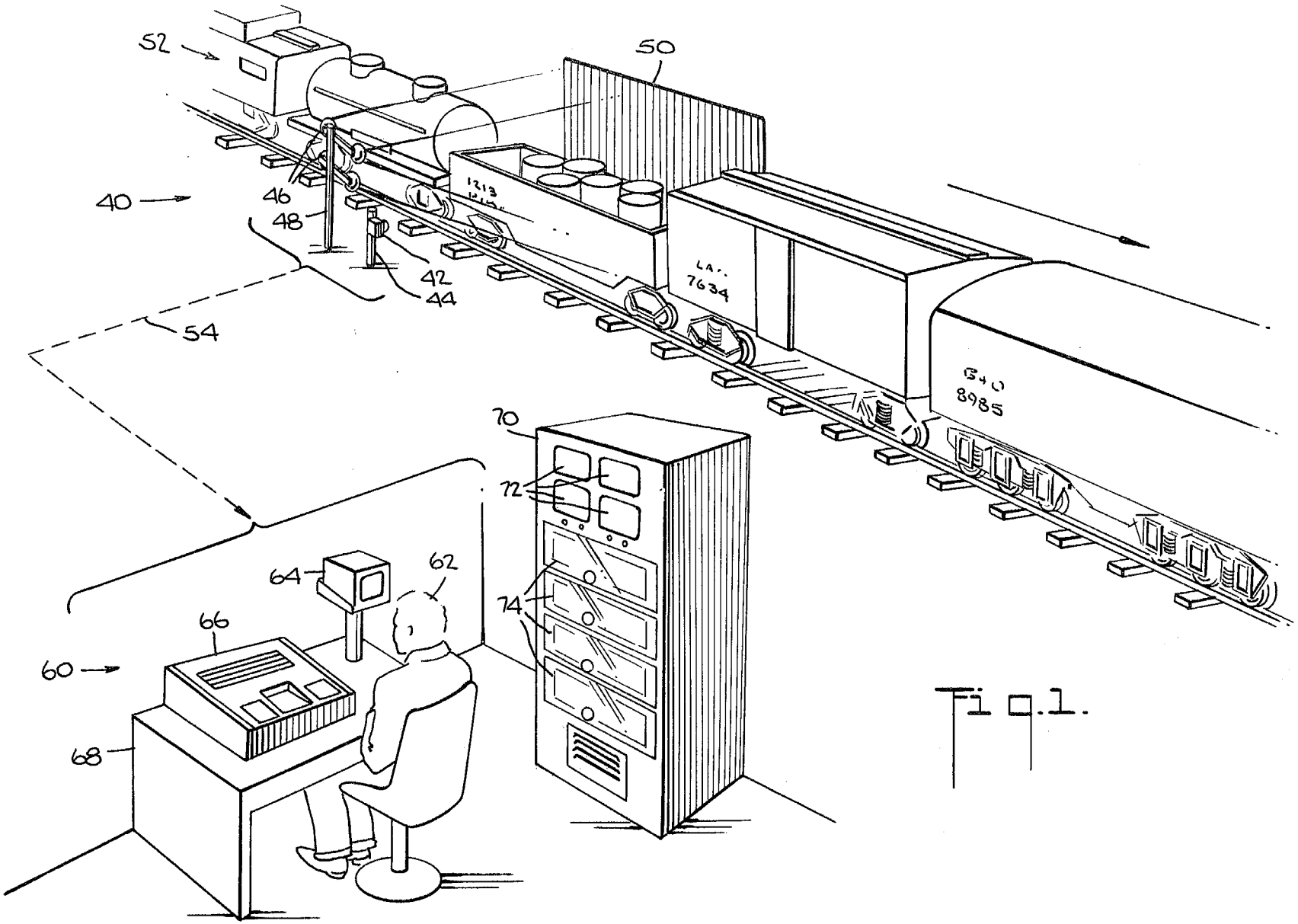
FIG. 1 is a split-action view showing a train at track-side passing by a reading unit and an operator at a remote location (yard or office) seated at a playback console.

FIG. 1 shows a particular track-side location 40 and a remote location 60. Housing 42 on pole 44 contains the reading unit, which is shooting passing train 52 against back-drop 50. Lights 46 on pole 48 provide additional necessary light.

Housing 42 contains various circuit modules and other equipment (to be described later) that convert the video signal and transmit the video information to remote location 60. (Transmission is indicated by dashed line 54.)

The remote location contains equipment that receives, converts, and records video information, from four different track-side locations. Four videotape recorders 74 are shown, one for each location. Cabinet 70, in addition to the four videotape recorders, also contains four video monitors 72, one for each track-side location. Each monitor continuously displays in real-time the information being received from the corresponding track-side equipment.

Operator 62 is seated in front of playback console 68, and he is viewing in real-time or is playing back a previously recorded train movement. If the latter, a tape cassette recorded on one of the four recorders 74 will have been transferred to videotape recorder 66. Playback would be at a speed slow enough to permit the operator to identify the cars shown on video monitor 64, which would derive its picture from videotape recorder 66.

Figure 2:
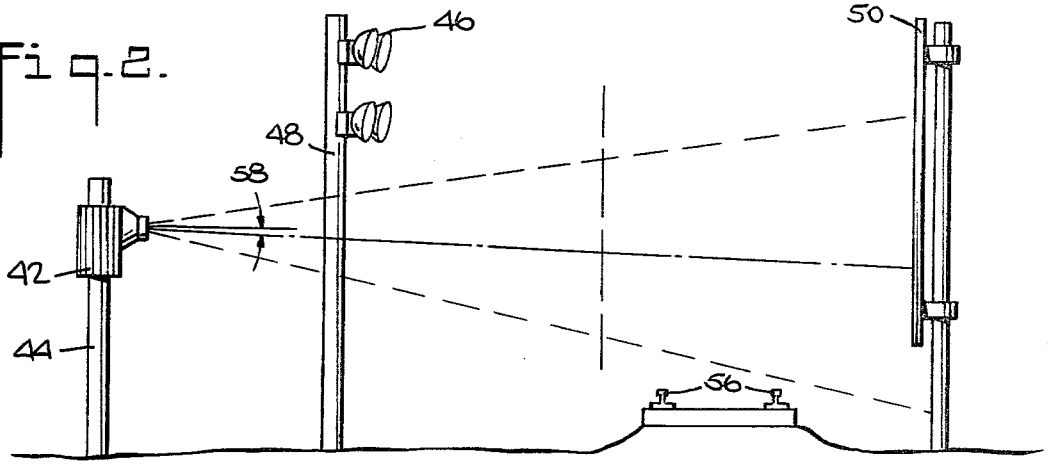
FIG. 2 is a side view of the track-side location of FIG. 1 (without the train)
Figure 3:
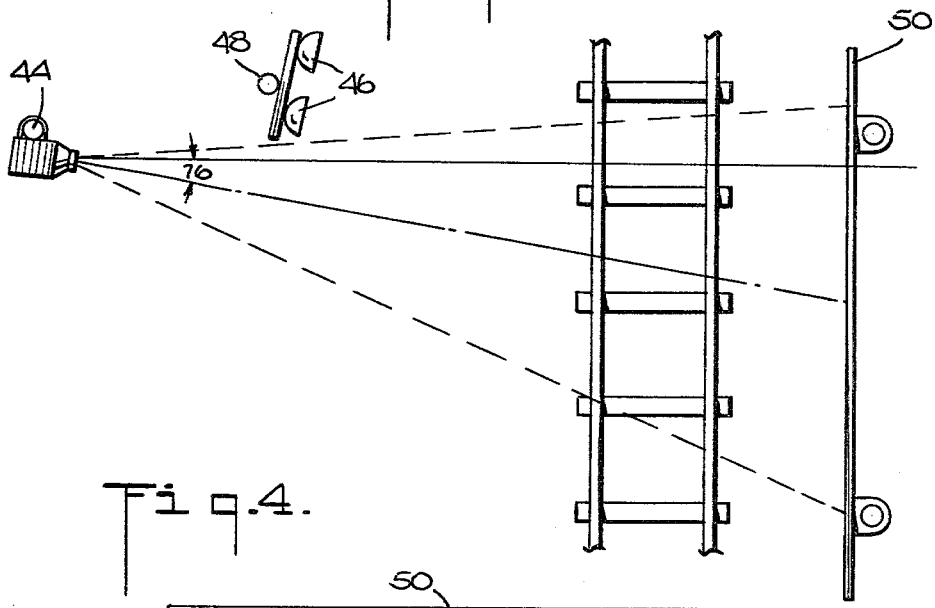
FIG. 3 is a top view of FIG. 2.
Figure 4:
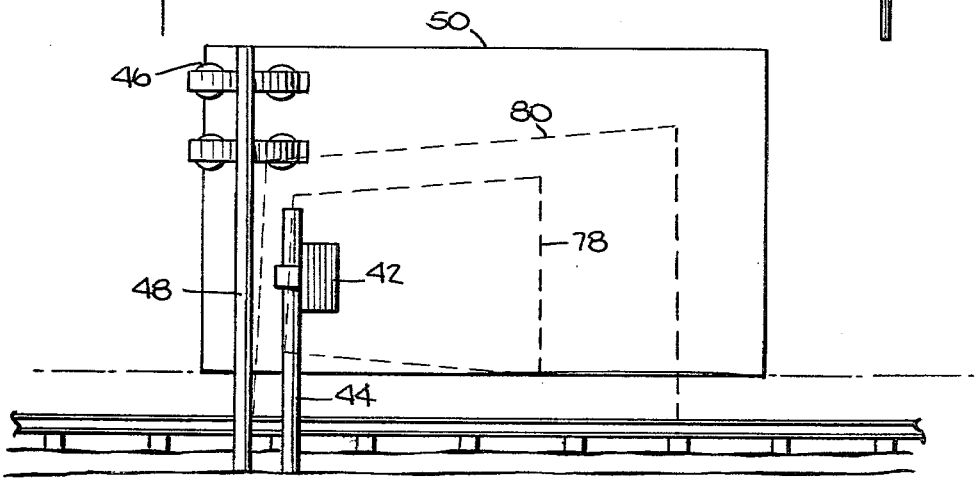
FIG. 4 is a front view of FIG. 2.

FIGS. 2, 3, and 4 show the preferred track-side equipment configuration when a 25 millimeter focal length lens is used with the camera. (As is obvious, other focal lengths may be used, depending on the site.) Lights 46 are approximately 14 feet from the closer of train tracks 56. The camera lens in housing 42 is approximately 29 feet from the closer track. Back-drop 50 is about 11 feet from the closer of tracks 56. The center-line of pole 48 is about 25 inches to the left of the center-line of pole 44 (FIG. 4).

Use of a back-drop is preferred, although not essential. It may be of any color, but preferably is not white; the finish should be dull. Any suitable material may be used.

The top of back-drop 50 is about 16 feet above tracks 56. The lights are from 11 to 16 feet above the tracks, and the lens is approximately 8 feet above the tracks.

To prevent unwanted reflections and other optical problems, housing 42 (and thus the camera) and lights 46 are tilted down approximately 2.5 degrees from the horizontal (angle 58 in FIG. 2) and are rotated approximately 10 degrees from the perpendicular to the back-drop (angle 76 in FIG. 3). Dotted line 78 indicates the area of the side of the train seen by the camera; dotted line 80 indicates the part of the back-drop seen (assuming a train is not present). (Both dotted lines are approximately to scale.)

Lights 46 usually have a color temperature of from about 2800 to 3400 degrees Kelvin. (Lights with lower or higher values may be used, but filters should also be employed.) Desirably, the lights should be capable of full light output instantaneously. Preferably, clear quartz lights are employed.

Figure 5:
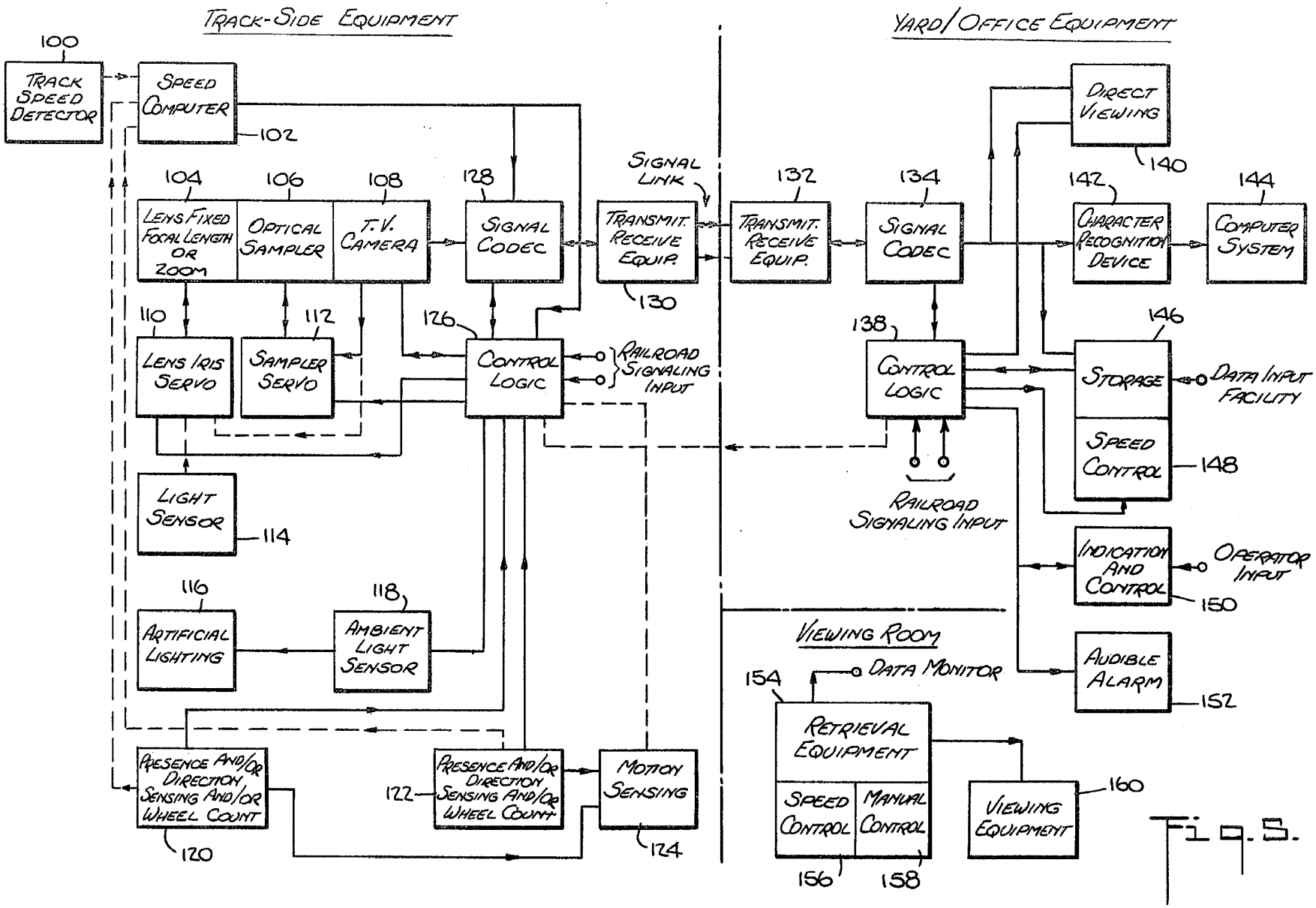
FIG. 5 is a general system block diagram.

FIG. 5 is a block diagram of a generalized system embodying the present invention. The reading unit comprises an optical sampler and a television camera, and may be considered also to include a lens, a lens iris servomechanism, a sampler servomechanism, and a light sensor (blocks 106, 108, 104, 110, 112, and 114, respectively). The lens is standard and may be either fixed focal length or zoom. The diaphragm (or iris) is controlled by the lens iris servomechanism, which is informed of the available light by the light sensor.

The optical sampler is a disc having cut-outs (or notches). It is rotated by the sampler servomechanism to freeze the action (train movement) for the camera. This prevents optical blurring. Passage of the cut-outs in front of the camera target is synchronized and phased with the vertical scanning of the camera. Additionally, when the camera is not being used, the servomechanism moves the disc to blank the pick-up device of the camera. This prolongs the life of the device. Preferably, the sampler servomechanism employs a pulse (stepper) or variable reluctance motor. Other types of motors may be used, but they may not last as long as the preferred motors.

Desirably, the camera is a black-and-white, television-type camera having high resolution and a panchromatic spectral response. It must be a very high quality pick-up. The preferred camera is the TC-1005 of RCA (Radio Corp. of America). The pick-up device ideally has zero lag after one field; however, up to approximately 10 percent retention after 16 milliseconds is acceptable. Desirably, the pick-up device uses lead oxide or is a silicon diode array or is a Newvicon (trademark) from Matsushita. The most preferred tube is the Plumbicon (trademark) of Amperex (lead oxide target). If other than a lead oxide pick-up is used, infrared-cutting filters (e.g., Fisher HAll) may be needed to bring the spectral response as close as possible to that of the human eye.

Track-side artificial lighting (block 116) has already been described above, in connection with FIGS. 2, 3, and 4. The ambient light sensor (block 118) is of standard design and, desirably, is located within the track-side equipment housing (reference number 42 of FIGS. 1 to 4). If there is insufficient ambient light (below approximately 700 to 1000 foot-candles), the lights are activated.

The approach and direction of a train on the track are sensed by the presence/direction sensing equipment of blocks 120 and 122. Any standard equipment may be used for sensing approach. This includes insulated-track type, shunt-type (preferred), Doppler, and magnetic wheel detectors. The approach equipment should be located at a distance up the track from the reading unit and lights. This distance is usually at least 250 feet, which provides a 3-second lead time for an approaching train travelling at 60 miles per hour. The direction of train travel can be determined by the logic (block 126) from information from the presence detectors. Two-phase overlapping pulses may be used.

Motion sensing equipment (block 124) senses if the train is moving. This is important because, for example, if the train stops in front of the camera, recording of the video signal can be halted to reduce the amount of video storage medium (e.g., videotape) used. Additionally, other actions, such as blanking the pick-up device and cutting voltages, can be taken to reduce power consumption and prolong equipment life. Any standard motion sensing equipment can be used; microwave is preferred.

The speed of the train can be used to set the speed of video recording. Desirably, at speeds of 8 miles per hour or more, recording speed is normal, but at slower train speeds, recording speed is reduced to decrease the consumption of the recording medium and to decrease playback time at normal playback speed.

If a shunt-type or insulated-track type presence detector is used, a train speed detector and computer (blocks 100 and 102) are needed. (Those two types indicate presence by completion of a circuit and, thus, logically are on or off. Therefore, speed cannot be determined from their condition.) If other presence detectors are used, e.g., Doppler or magnetic wheel, a separate speed detector and computer are not necessary. Any standard speed detector and computer may be used. A microwave detector is preferred.

Indications of presence, motion, direction, and speed may be used for various purposes in addition to those mentioned. For example, if a train reverses direction in front of the camera, recording would probably not be desired until the train has again reversed direction and the cars already recorded have passed. In this case, wheel counting would be used to prevent re-recording of the earlier cars. (A camera in a pull-down yard where a train was being made up would be exposed to repeated back and forth train movement.) Other uses are to prevent recording the passage of single cars (which would be engines) and to cause recording of traffic in only one direction.

Obviously, indication of one parameter can imply another. For example, initial presence detection implies motion. This fact can be utilized by the system logic.

The control block (block 126) receives information from the various detectors and controls most of the track-side functions.

The signal codec (coder-decoder) (block 128) encodes the video signal from the reading unit for transmission to the remote location (yard/office) by the transmission/reception equipment (block 130). Track-side status information (e.g., whether a train is present and moving) desirably is also transmitted to the remote location. The status information may be encoded on the video signal or may be sent separately.

Transmission of video information to the remote location (from block 130 to 132) may be accomplished in any suitable manner. For example, base-band video (e.g., with correction amplifiers), RF multiplexing, microwave, fiber optics, or optical links may be used.

Operator commands and other information sent from the remote location to track-side desirably include turning on some or all of the track-side equipment for maintenance, preventing recording, for example, when the next train passes, and enabling the auxiliary equipment.

The reverse-direction information (from remote location to track-side) can be transmitted in any suitable manner. For example, if base-band video links track-side to the remote location, regular coaxial cable is employed, and the reverse information can be sent as direct current pulses of varying durations. If the video is RF multiplexed, coaxial cable is again used, but DC pulses cannot be used. Instead, a new technique involving power modulation (to be described) may be used. If the video is sent using microwave or fiber optics, reverse-direction information may be sent using a standard two-wire pair. This pair may be a telephone line, but if a grade is used that will not pass DC (e.g., AT&T grade 3002), the information must be converted to AC (for example, with a modem). If more than one track-side location is connected to a remote location, the reverse information may be time-division multiplexed.

The remote signal codec (block 134) decodes the video and status information received and encodes information (e.g., operator commands) to be sent. It is analogous to the track-side codec (block 128). After decoding, the video signal is stored for later playback (block 146) and may be viewed on a monitor (block 140). An optical character recognition device (block 142) may also scan the video, ascertain the identifying data on each car, and input the information to a computer (block 144).

Ideally, for later playback, disc storage is used. It allows random access, and, because the read/write mechanism does not touch the disc, the stored data is not degraded if the operator pauses on one scene for an extended period during playback. However, for economic reasons, disc storage is normally not used.

Instead, the usual storage means is videotape, preferably having thick backing tape. The videotape recorder should be capable of operating at different speeds so that slower recording speeds may be used for slower train speeds. (Speed control is indicated by block 148.) The preferred recorder is the Sony TV09000.

The date and time or other data may be input to the storage device and recorded with the video for precise record-keeping. Such data input is indicated by the arrow to block 146 labelled "Data Input Facility."

Block 150 (Indication and Control) represents the operator's control board with various indicators (e.g., lights), control push-buttons, etc. Entry of commands for the track-side equipment is indicated by the arrow to block 150, "Operator Input." An optional audible alarm to signal, for example, completion of recording of a passing train is shown in block 152.

Equipment for playing back the recorded video information is represented by blocks 154, 156, 158, and 160. Usually the same kind of equipment will be used for playback as was used for recording. Thus, if a Sony TVO9000 was the recording device, it preferably will be the playback device (block 154). Desirably, a separate recording unit is dedicated to each track-side location and another unit is used for playback, so as not to interfere with any of the dedicated recording units.

Speed control (block 156) is the playback unit's own variable speed mechanism, which permits the operator to select a faster or slower playback speed than that used for recording. Manual controls (block 158) are operator-controlled over-rides, which, for example, permit the operator to pause on playback to view a scene for an extended period. The viewing equipment of block 160 is a video monitor.

It is important that pausing to view a scene does not cause picture break-up (due to degradation of the recorded signal on the recording medium). That is why if videotape is used, the Sony TVO9000 is preferred: the tension it puts on the tape is minimal and the spinning record/playback head barely touches the tape surface.

The remote location control logic (block 138) handles the operations described above (except for playback). The arrows to the track-side and remote control logic (blocks 126 and 138, respectively) labelled "Railroad Signaling Input" indicate control signals directly from the railroad to the system. These signals may be from the railroad's own presence, motion, speed, or direction sensors.

Figure 6:
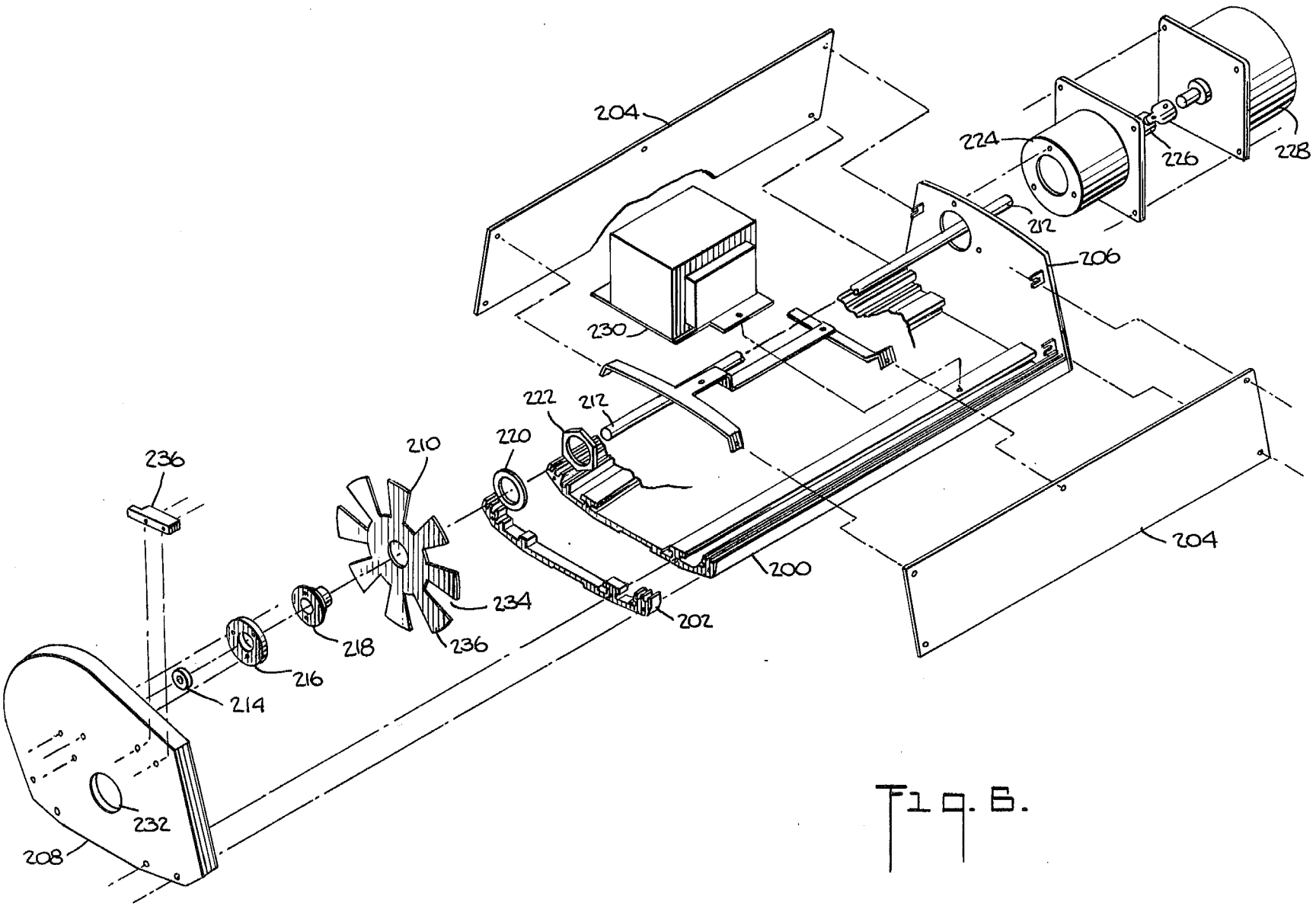
FIG. 6 is an exploded partial view showing the optical sampler within a reading unit.

FIG. 6 is a partial exploded view of the preferred camera, RCA's TC-1005, modified to contain an optical sampler (other camera equipment, such as, the pick-up device and the circuitry, is not shown). The housing comprises bottom plate 200, bottom extension plate 202, side boards 204, rear plate 206, and front plate 208 (the top plate is not shown). Bottom extension plate 202 lengthens the housing to accommodate sampler 210.

Sampler 210 is fixedly mounted on shaft 212 by mounting hub 218, washer 220, and nut 222. The sampler and shaft are rotatably supported at one end by bearing barden 214 and housing bearing 216, and at the other by motor mounting bracket 224. Universal joint 226 transmits the rotation of stepper motor 228 to shaft 212. Transformer 230 provides electrical power for the circuitry.

Sampler 210 is a disc having eight cut-outs (or notches) 234 around its periphery. Rotation of sampler 210 periodically and momentarily cuts the light entering through hole 232 in front plate 208, thus freezing the action, before the light enters the lens system and video tube (neither of which is shown). The disc may be of metal, but this causes high-frequency attenuation of the video signal (due to capacitance between the disc and video target). If metal is employed, corrective circuitry may be required. Preferably, however, the disc is made of plastic, thus eliminating the problem. Additionally, the axis of disc rotation preferably is perpendicular to the video target.

To lengthen pick-up device life, when the camera is not shooting a passing train, sampler 210 is rotated to place one of the eight peripheral fingers 236 in the light stream, thus blanking the pick-up device by preventing light from reaching the video target therein. Block 236 contains a light source and sensor for determining the position of the sampler. Light from the source is reflected by marks on the fingers of the sampler back to the sensor.

The remaining drawings depict circuitry for one particular embodiment of the more general system of this invention shown in the block diagram (FIG. 5). Before turning to the specific circuitry, certain system concepts utilized in the design of this embodiment will be discussed.

This specific embodiment comprises one remote (yard/office) location and up to five track-side locations. Status information is sent from each track-side location to the remote location by the on or off status of four bits (on indicates a positive logic status). The first bit indicates whether presence is sensed (the railroad is providing its own presence detection equipment); the second, whether motion is sensed; the third, whether the auxiliary equipment at track-side is on or off; and the fourth, whether "one move cancel" is enabled. The first three require no further explanation; the last is explained as follows.

"Move" refers to the movement of a train past the camera. A move starts with the approach of the first car and ends ("move end") with the passage of the last. The one move cancel bit is set by the operator at the remote location to prevent the camera from shooting the next train to pass. Thus, that move will not be recorded. One move cancel may be utilized, for example, when a train is going to pass the camera again because the train has backed up completely after having already been recorded.

The operator may give various commands to each track-side location, including: turn on or off the auxiliary equipment (e.g., rain wipers and ice-melting equipment), enable or disable one move cancel, and enable or disable "track-side run." The first two have been expalined; the third command is usually sent for maintenance purposes. When track-side run is enabled, the motion bit at the corresponding track-side location is turned on without turning on the presence bit. This turns the track-side equipment on (places the equipment, including the camera, in run mode) without turning the recorder on and enables the operator to check the camera without wasting videotape.

There are two modes of operation, standby and run. In standby mode, the system is ready to run: in the reading unit, the pick-up device is blanked, the current through the heater filament in the pick-up device is reduced and the high voltage in it is cut; presence detection equipment is enabled; and the video signal is being sent (to transmit the four status bits), although the picture is "black." In the run mode, the sampler unblanks the pick-up device and rotates at the required speed; normal filament current and high-voltage are restored;

and pictures of a moving train are transmitted and recorded.

This specific system employs one modified Sony TVO9000 per track-side location plus one for playback, and one RCA TC-1005 camera per track-side location. Each camera is modified as shown in FIGS. 6 and 7 and contains an Amperex Plumbicon pick-up device.

Conventions used for the circuit diagrams are as follows: all resistors are ¼ watt, 5 percent tolerance unless otherwise noted; and capacitance values given with "K" refer to thousands of picofarads.

Figure 7:
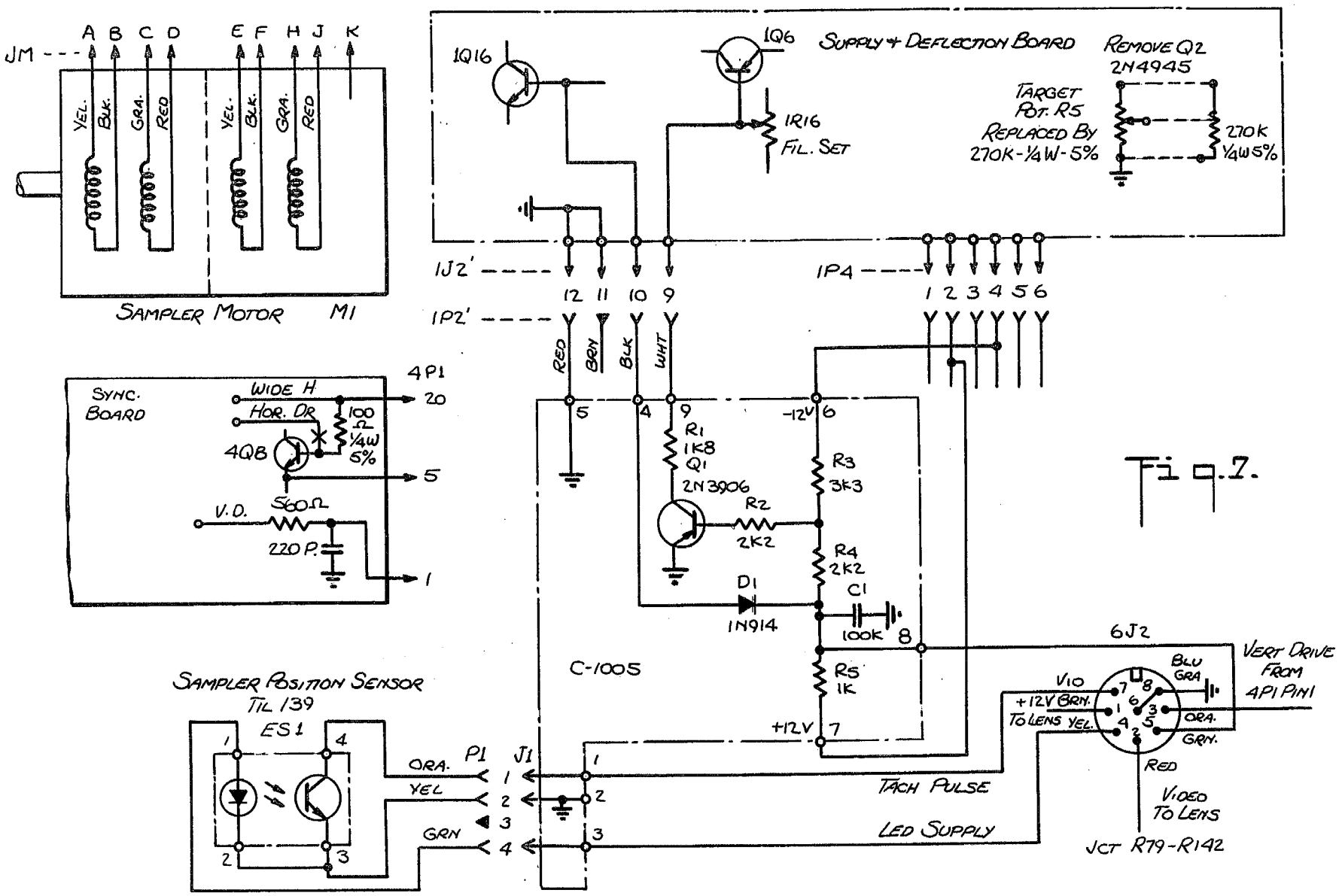
FIG. 7 is a circuit diagram for a reading unit standby and sampler position sensor module.

Turning now to the circuit diagrams, FIG. 7 depicts circuitry at track-side for electrically isolated remote control of the camera for reducing filament current, cutting high voltage, and blanking the pick-up device. (A schematic of the standard circuitry for the TC-1005 is known or available to those skilled in the art.)

Figure 8A:
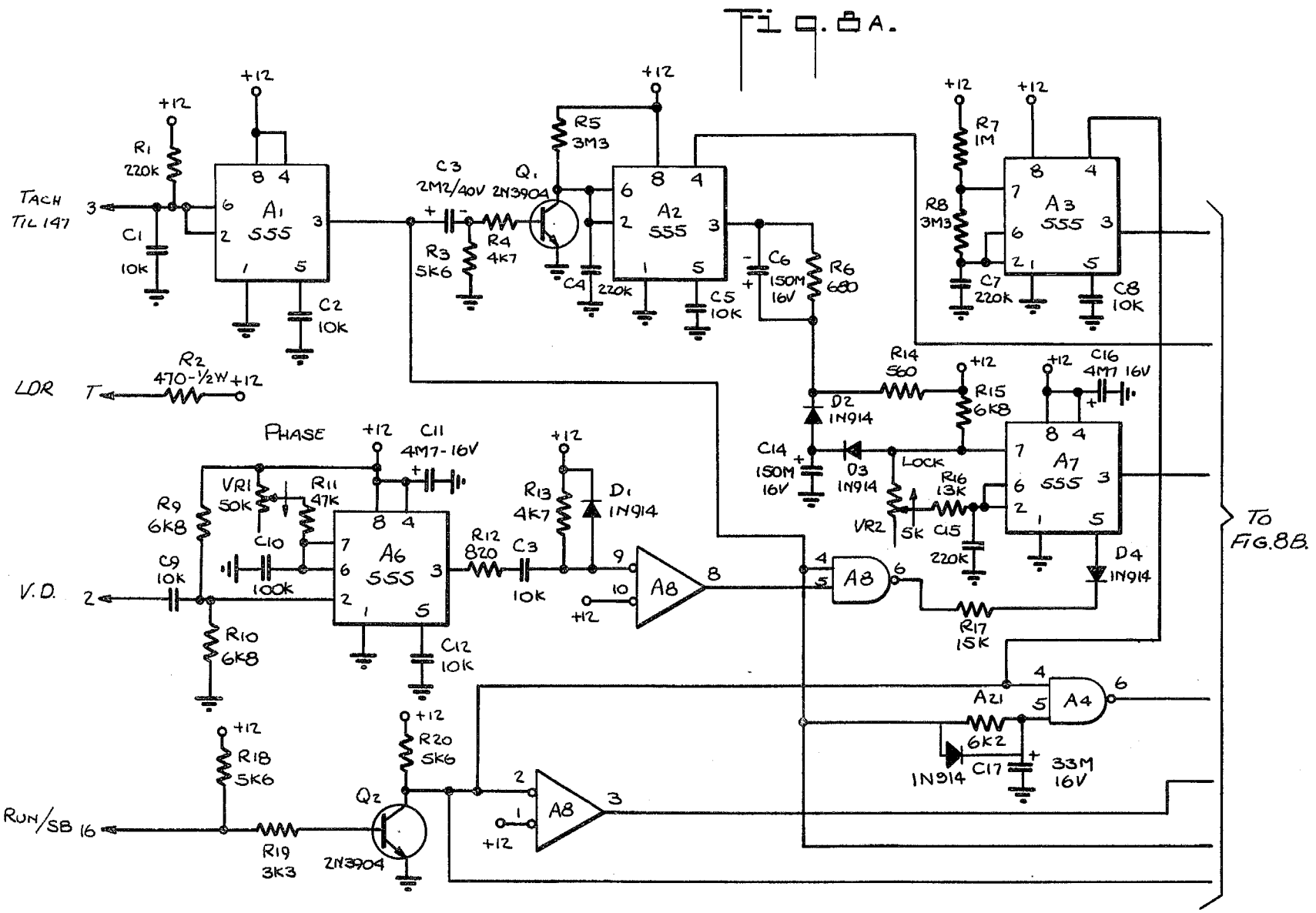
FIG. 8 (8A, 8B, and 8C) is a circuit diagram for control of track-side lighting and of temperature within a reading unit housing.
Figure 8B:
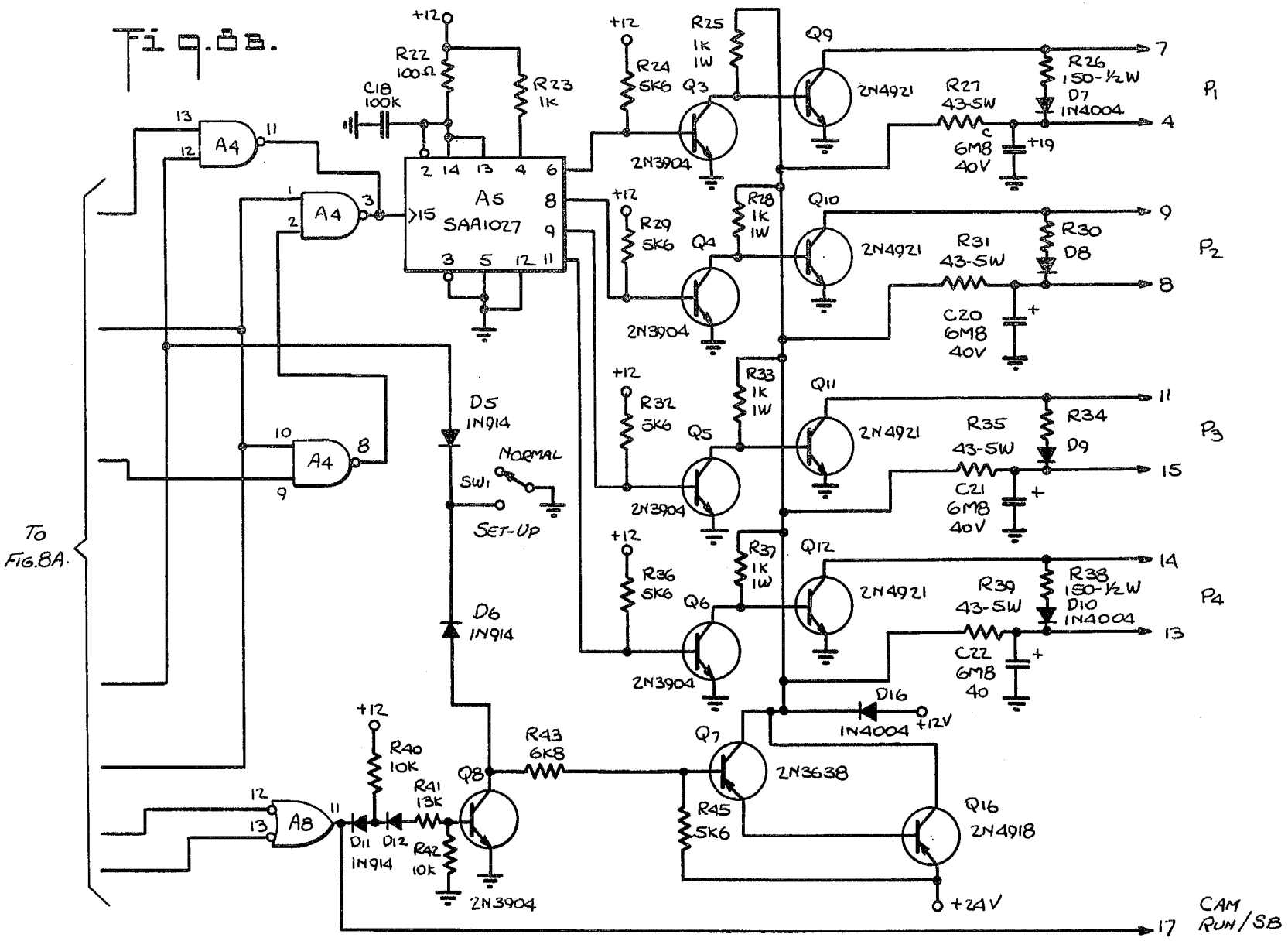
Figure 8C:
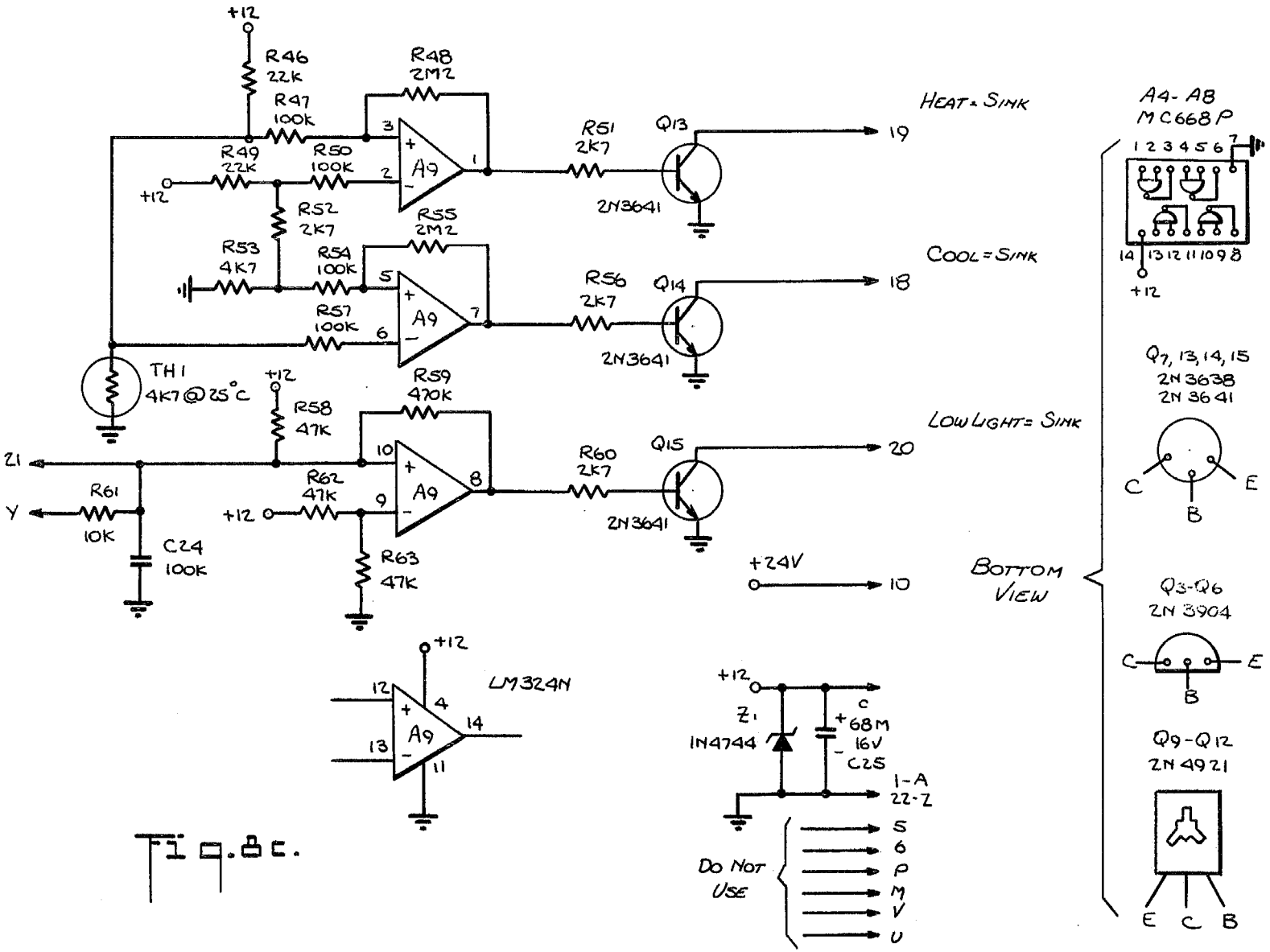
Figure 9A:
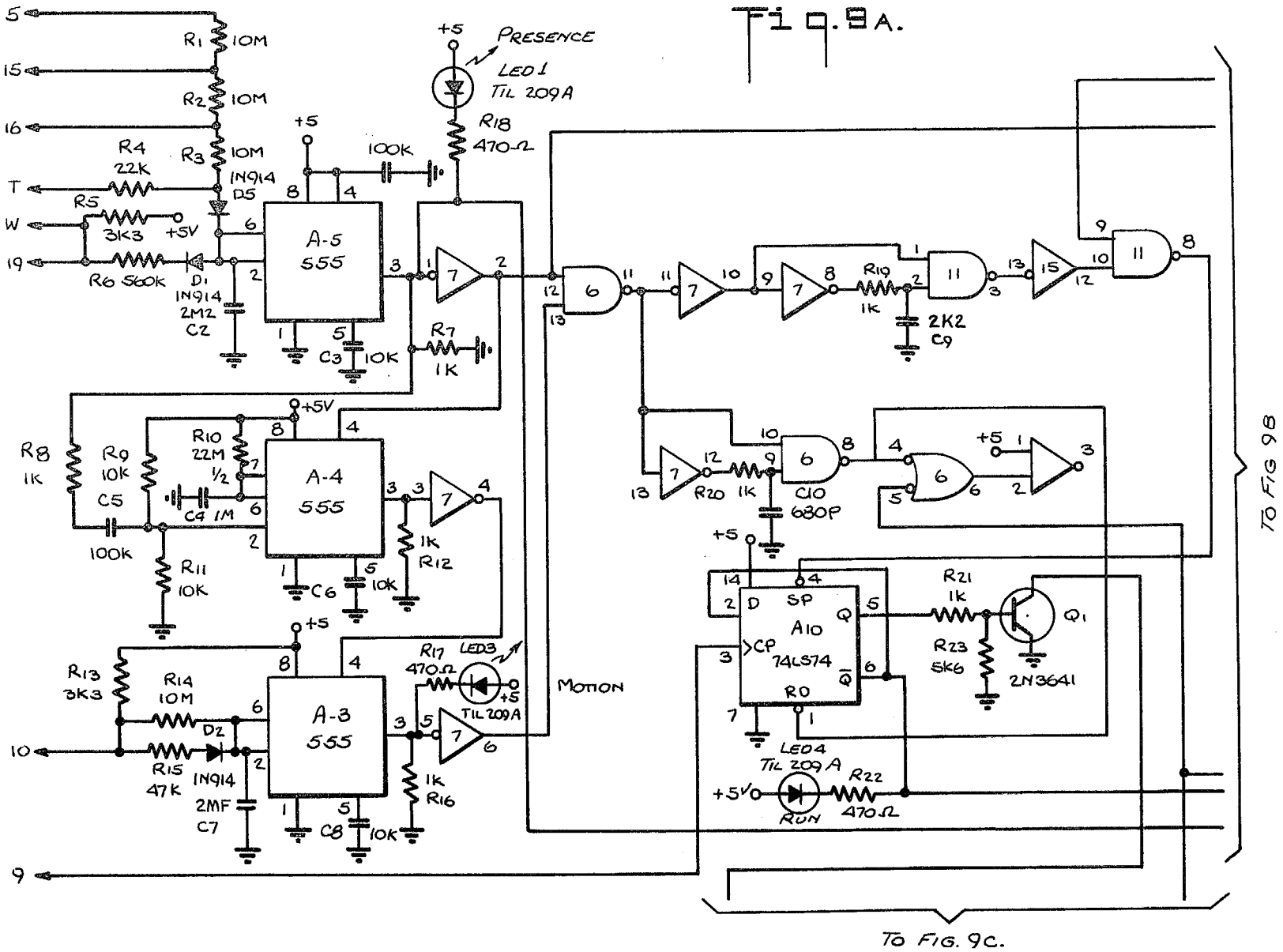
FIG. 9 (9A, 9B, 9C, and 9D) is a circuit diagram for track-side logic and a vertical interval pulse (V.I.P.) encoder.
Figure 9B:
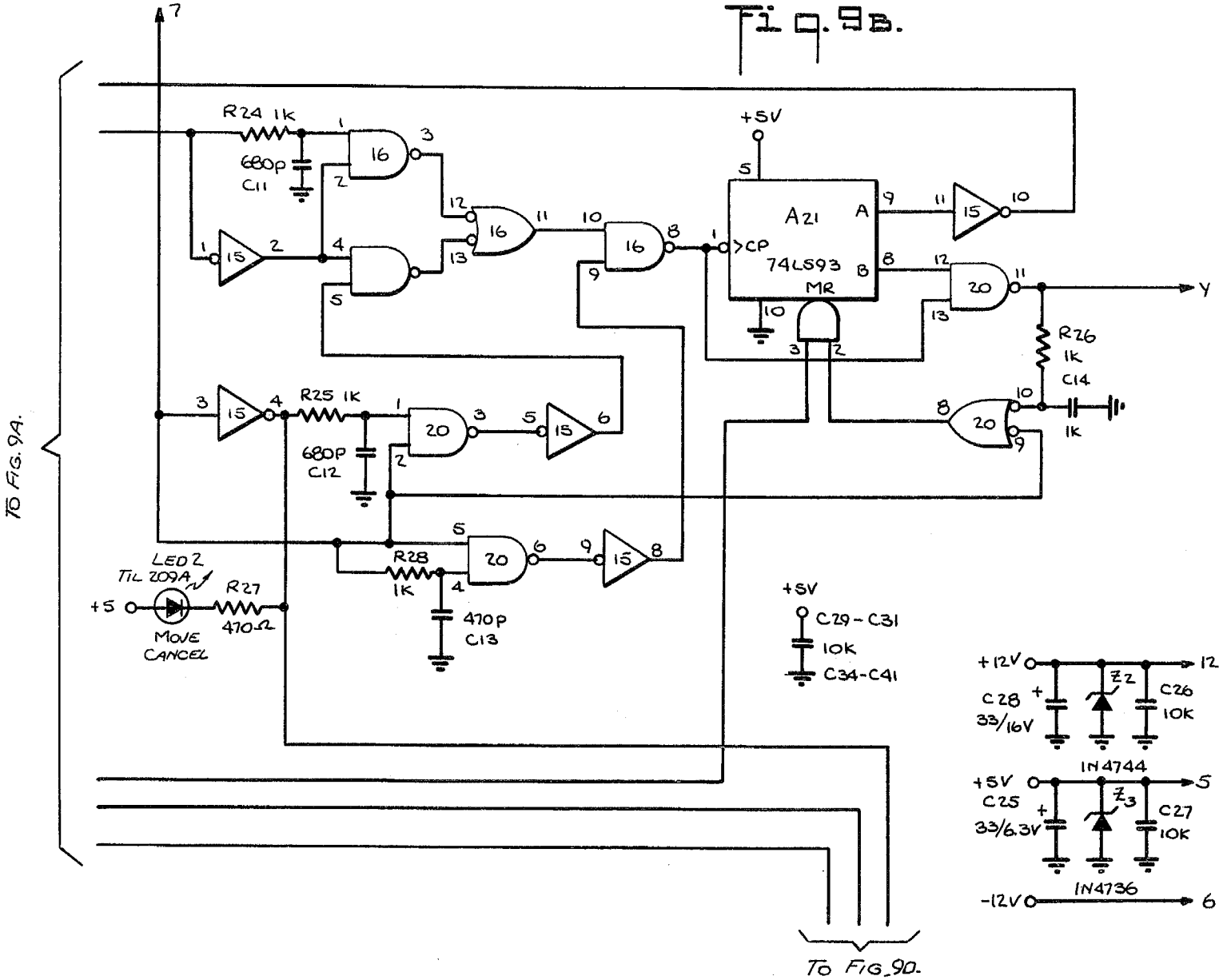
Figure 9C:
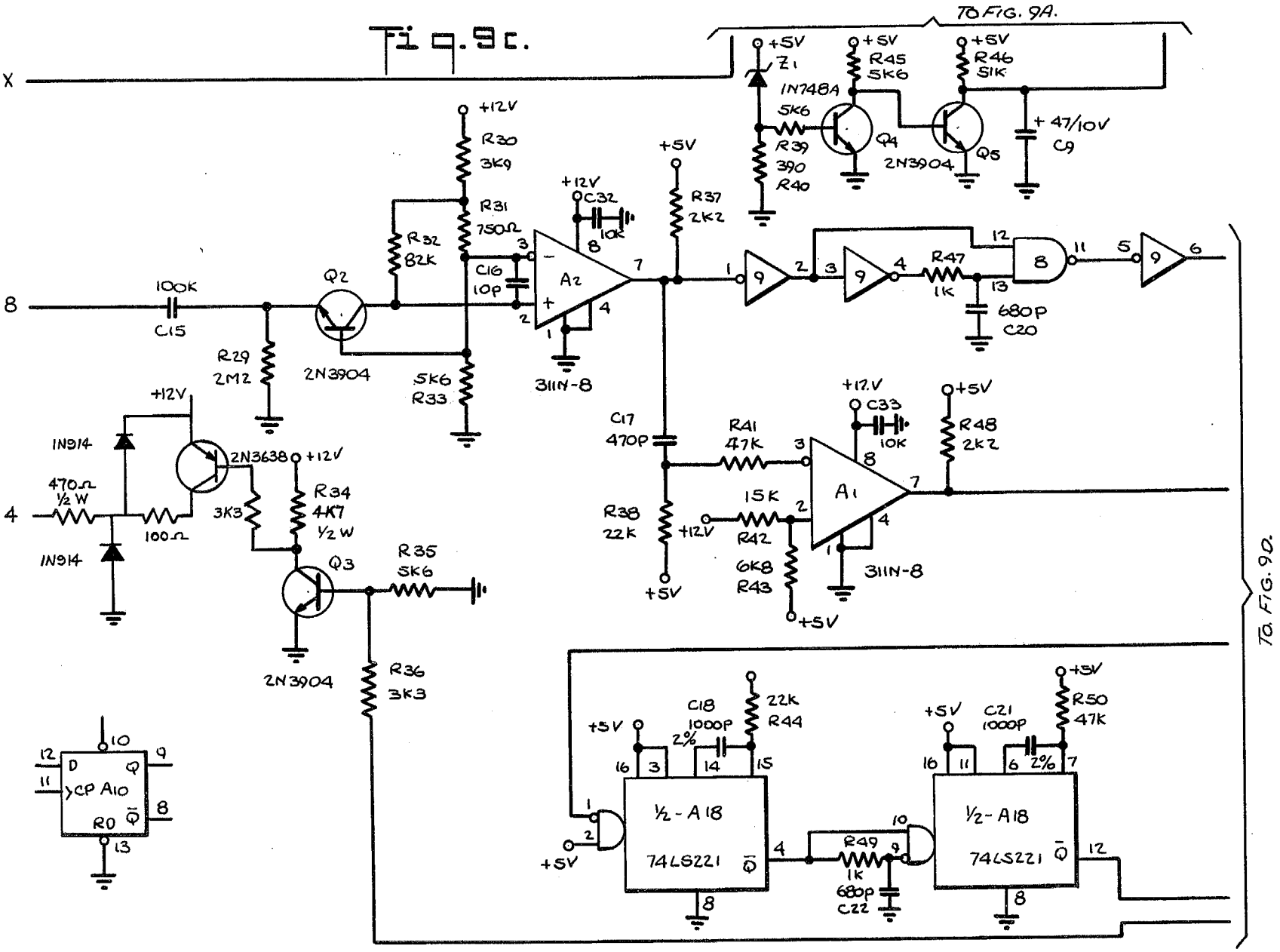
Figure 9D:
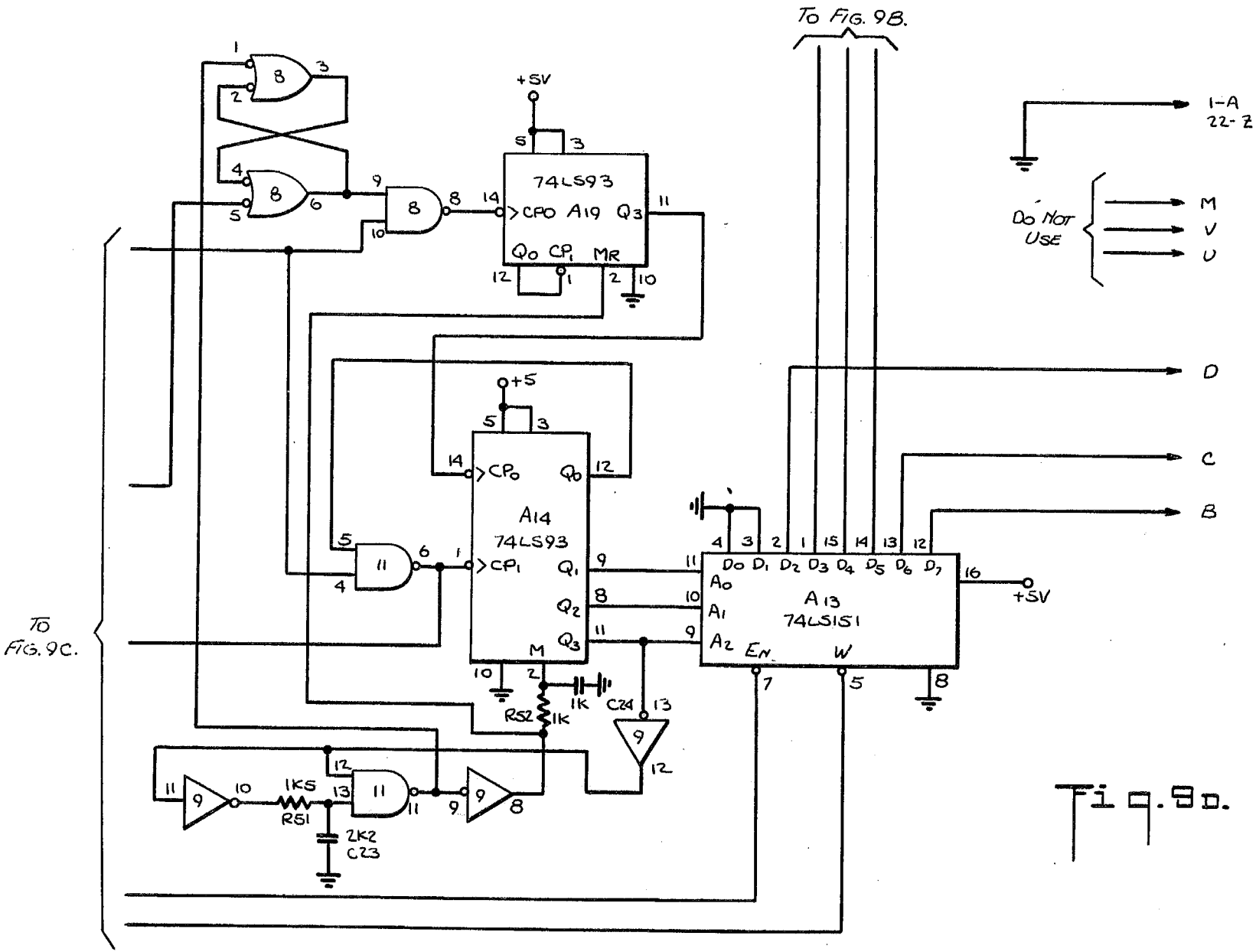

The circuitry of FIG. 8 is at track-side and controls the camera mode (i.e., run or standby mode), the movement of the shutter mechanism (sampler) of the camera, the temperature within the track-side cabinet, and the outdoor track-side lighting. For camera control, the run/standby signal on pin 16 is buffered on pin 17 to enable the camera directly.

Pin 3 connects to the source and sensor assembly of the camera. Light reflected from any of the eight fingers of the sampler disc causes the sensor to turn on for 1 or 2 millisecond (depending on the width of the cutouts) at a rate of 60 Hz during normal run-mode operation. The sensor aligns the shutter for synchronized operation with the camera.

Pin 2 connects to the camera vertical drive output. Resistor VR1 is adjusted to set the delay of timer A6 (phase) and assures synchronization between the shutter mechanism and the camera video scan.

Timer A7 is a nominal 180 Hz oscillator, synchronized to both the shutter and the video via A8 and D4, to obtain proper phase control. VR2 is a lock-adjust set for proper synchronization frequency.

The circuit comprising Q1 and A2 assures slow-speed start-up of the sampler drive motor. Before start-up, tach pulses are not being received, and pin 3 of A2 is low. By means of R6, R14, and D2, this lowers the free-run frequency of A7, thus assuring start-up from a non-run condition. As the disc's speed increases, pin 3 of A2 goes high, and the frequency of A7 increases to that required for an optimum picture.

Timer A3 is a nominal 2 Hz timer, which moves the shutter slowly until blanking (or capping) results. This protects the camera's pick-up device when the unit is in standby mode. Pin 16 is derived from the track logic module (FIG. 9) and is high level when the run mode and low level when in standby mode.

In run mode, A7 is connected by A4 pin 8 to the stepping motor control to obtain the normal run rotation of 60 Hz. In standby mode, A3 pin 3 is enabled to the stepping motor control until the position sensor sees a capped position. Then, A3 pin 3 is disabled and power to the motor is reduced by Q8 cutting off Q7 and Q16. Circuit A5 controls the four phase connections to assure proper direction and motion speed in operation.

Thermistor TH1 on the module aids in temperature control. Its nominal resistance is 4.7 Kohms at 77° F. (25° C.) and the voltage at the junction of R46 and TH1 is 2.1 volts. As the temperature increases, the resistance of TH1 decreases. At 82° F. op amp A9 pin 7 switches (voltage on TH1 approximately 1.8 v) to +12 volts, turning Q14 on, which, in turn, initiates cooling. When cooled to 72° F., the resistance of TH1 increases and the voltage is about 2.3 volts. This causes op amp A9 pin 7 to switch to zero 0 volts, which halts cooling.

At 58° F. op amp A9 pin 1 switches to +12 volts (voltage on TH1 approximately 3.2 volts) turning Q13 on. This initiates heating. When the temperature reaches 66° F., the resistance has decreased sufficiently so that op amp A9 pin 1 switches to 0 volts, thus halting heating.

A light sensor is mounted near the camera window. When light level falls below 1000 ft-candles (voltage on pin Y is 4.7 volts), op amp A9 pin 1 switches high, turning transistor Q15 on. Above 1000 ft-candles, op amp A9 switches low, turning transistor Q15 off. The run and low-light relays are connected in series so that the lights are off when a train is not moving in front of the camera.

The circuitry of FIG. 9 is at track-side and controls the camers and track lights and encodes the track-side equipment status onto the video signal. Status information enables proper operation of the video recorder and causes the appropriate display lamps at the operator console to light.

A positive indication that a train is present (i.e., a signal from a presence detector) causes a relay in the track-side equipment housing to de-energize, removing the logic low input from pin 19. This allows capacitor C2 to charge to 1.7 volts, which causes A5 pin 3 to go low. Charge time can be varied to provide different delays between positive presence detection and the start of recording. For example, a jumper from pin 5 to pin W, causes a delay of 60 seconds. When A5 is low, LED 1 is on.

A change from negative to positive presence implies train motion. Pin 10 is connected to the motion detector, and positive motion removes the logic low input from pin 10. A4 causes A3 to go low for 25 seconds after the change from negative to positive presence, thus forcing a positive motion indication. LED 3 is activated when motion is detected or forced true. This scheme insures proper recording of a fast moving train in case the motion detector is located close to the camera (e.g., in the same housing).

When presence and motion are both detected (as, for example, when a motion signal is forced by initial presence detection), A10 is set via A6 pin 11 and A11 pin 8. This causes Q1 to saturate, gating common to pin X. This energizes a relay at track-side, turning the track-side equipment on and enabling the lighting equipment. LED 4 turns on (indicating that the track-side equipment is on) when A10 is set.

When motion or presence indication disappears, A6 pin 11 becomes logic high, thus resetting A10, turning the track-side equipment off via Q1, and turning LED 4 off.

When the operator wishes to change the status of video transmission (e.g., from transmitting to not transmitting), he depresses the track-side run or system run button at the console. This generates a 1 second on pulse, which, in turn, causes a pulse output from the pulse duration decoder. This changes the state of A10 via pin 9, thereby controlling the track-side equipment. If the equipment is on, it will go off, and vice versa.

When the operator wishes to enable one move cancel, a command is sent to the time duration decoder (FIG. 10), flipping pin 7 of the module to a logic high. This turns LED 2 on.

Normally, pin 7 is logic low and LED 2 is off. When pin 7 initially goes high, counter A21 counts to A: 1, B: 0. Thereafter, when presence is detected, gate 11 pin 8 is inhibited from setting A10 by inverter 15 pin 10. (Setting of A10 causes the track-side equipment to turn on.) After presence is removed (the move is complete), inverter 7 pin 2 goes low, causing A21 to count to A: 0, B: 1. This, by means of NAND 20 pin 11, causes the counter to reset to A: 0, B: 0, and, via the reset on pin Y, causes pin 7 to go low.

If the operator decides to abort the one move cancel before presence is detected and removed, he transmits a second command that makes pin 7 low and causes A21 to reset via gate 20. This enables future track-side equipment operation.

The digital status of presence, run, one move cancel, and an auxiliary function are continually transmitted to the console by encoding the status on the video signal. Thus, video transmission occurs at all times, even when the camera is in the standby mode (the monitor then displays a blank, or black, picture).

The digital status is transmitted piggyback on the video signal by encoding information in the vertical blanking interval of the picture. The encoding is based on the monochrome synchronizing signal waveform. Vertical blanking is accomplished by sending a series of equalizing pulses, vertical synchronizing pulses, equalizing pulses, and remaining vertical interval pulses. The encoder inserts white partial lines on the specific vertical interval pulses when the data bits are false.

Pin 8 is connected to the isolated camera video out. The circuit consisting of Q2, A2, and C15 detects every sync in the vertical blanking interval and is referred to as the sync separator. The circuit consisting of C17 and A1 (the vertical block separator) detects only every vertical sync pulse.

The first vertical sync pulse causes NAND A8 pin 6 to latch to a "1" level. This enables counter A19 and A14 flipflop Q0 to count the next 16 sync pulses before enabling A11 pin 6. Counter A14 (Q1, Q2, Q3) then counts sync pulses, and A18 generates enable pulses, from approximately the 25 percent point to the 75 percent point of an individual line.

Multiplexor A13 allows the level of the D input (corresponding to the count in A14) to output a low, which causes a white line on the following counts:

| Count | Function |
|---|---|
| 2 | Future expansion - Pin D inhibited (black) |
| 3 | Presence - White when presence not true |
| 4 | Run - White when run not true |
| 5 | One Move Cancel - White when one move cancel not true |
| 6 | Auxiliary - White when Auxiliary not true |
| 7 | Future expansion - Pin B inhibited (black) |

Figure 10B:
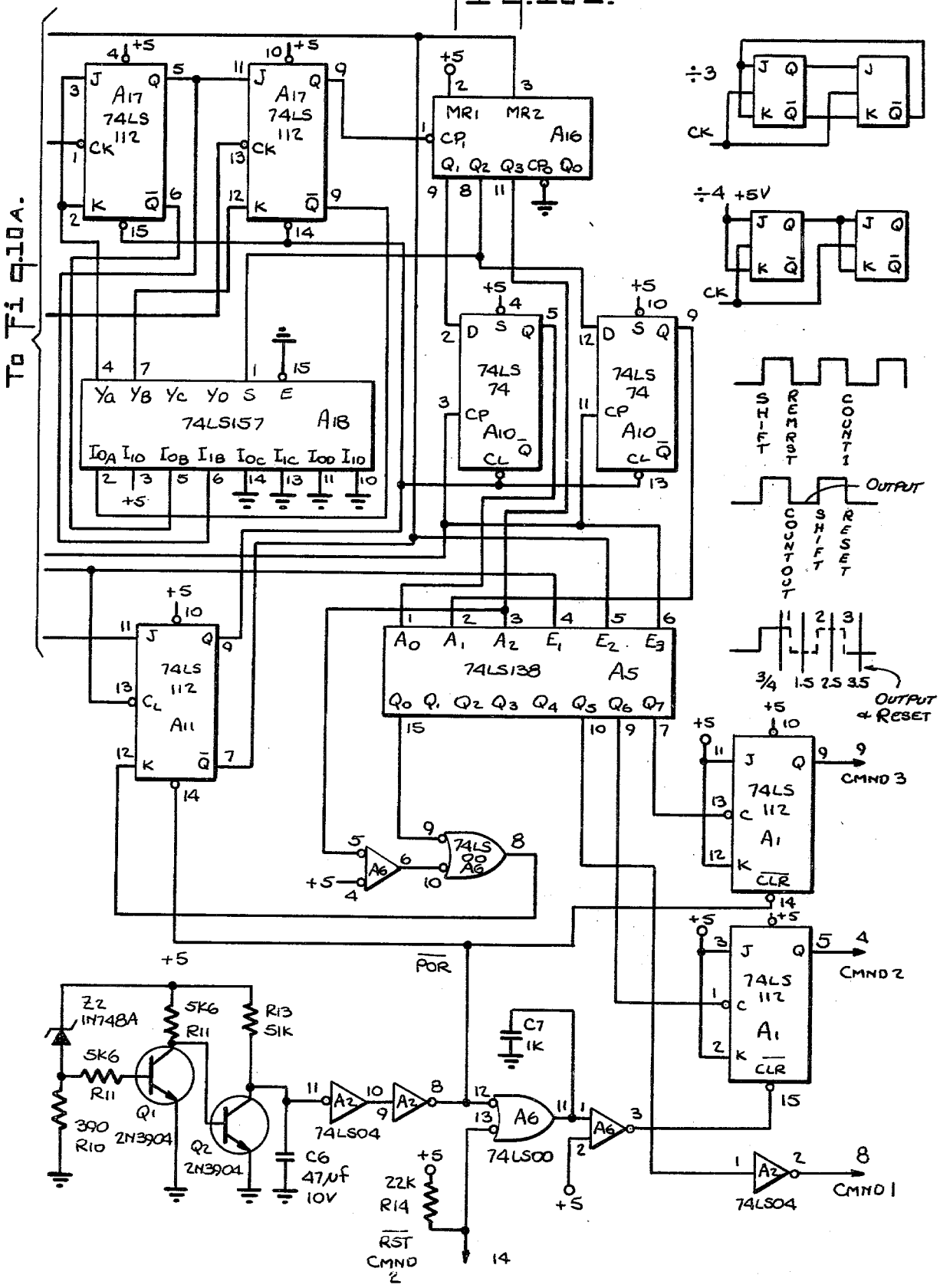
FIG. 10 (10A and 10B) is a circuit diagram for a time duration command decoder.

The module of FIG. 10 is located at track-side and decodes time-pulse modulated commands generated by the operator at the recording console. One of three basic commands may be sent:

(1) Trackside Run: turn on track-side equipment if off; turn off track-side equipment if on. (Encoded as a 1-second high pulse.)

(2) One Move Cancel: arm the system to prevent transmission from track-side of the next train movement if the camera is disarmed; disarm the system to allow transmission of the next train movement if the system is previously armed. During normal operation, every valid train movement is transmitted. (Encoded as a 2-second high pulse.)

(3) Auxiliary Control: Turn on auxiliary equipment if off; turn off auxiliary equipment if on. (Encoded as a 3-second high pulse.)

The basic time pulse may be modulated on the baseband video signal directly. Alternatively, the time pulse may be multiplexed on RF amplifier power lines or on telephone lines when RF muliplexing or microwave transmission is used to transmit video from track-side to the remote console. If the time pulse is sent multiplexed, it is demultiplexed and restored to a DC pulse for decoding by the circuitry of FIG. 10.

Figure 16:
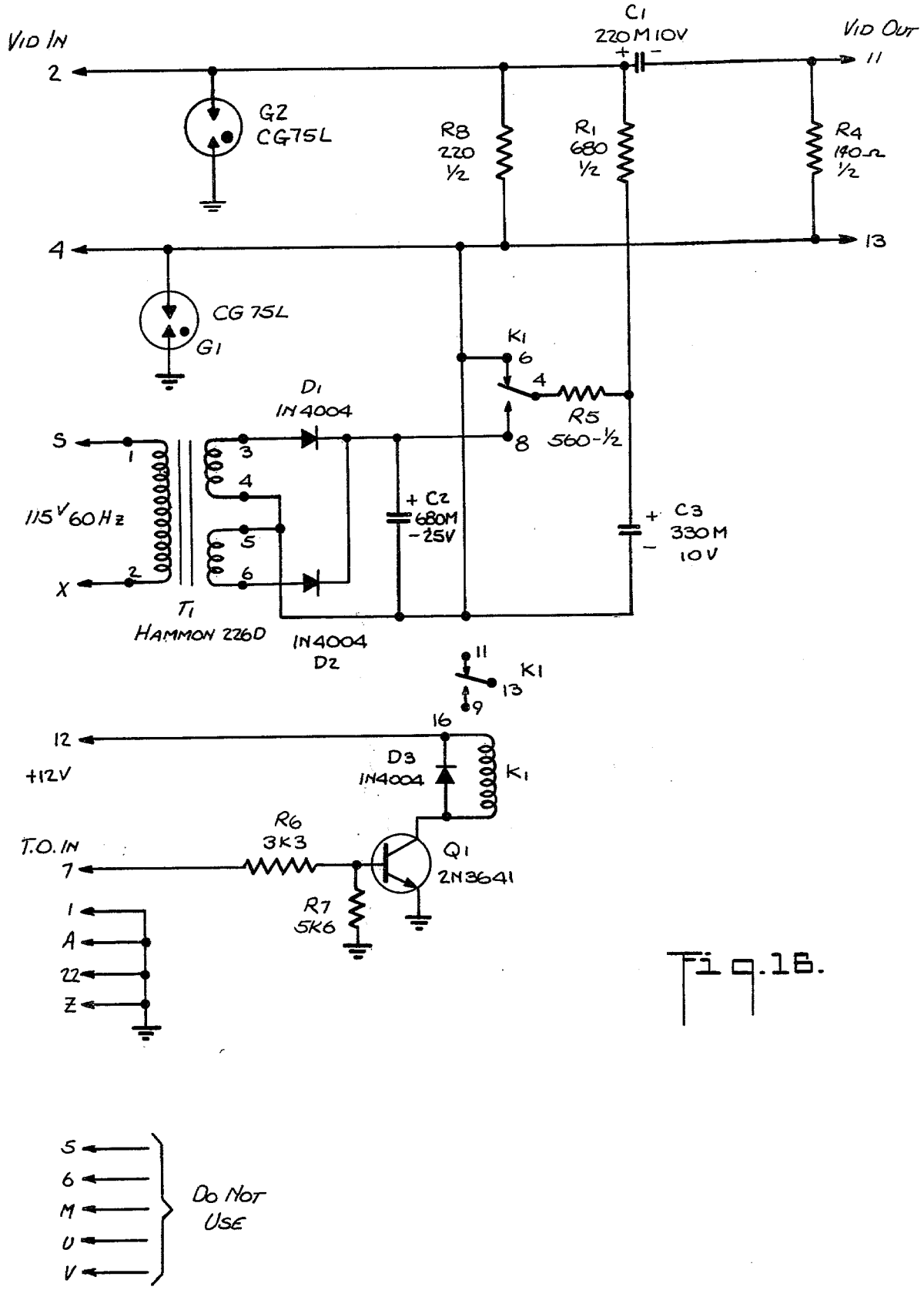
FIG. 16 is a circuit diagram of a time duration combiner.

The basic pulse input is obtained from the DC bias on the coaxial cable and is generated remotely or locally by the time duration combiner module (FIG. 16). R7 allows adjustment for minimum time bias shift; the adjustment minimizes the pulse time distortions.

LED 1 in on when the pulse is recognized as a high level (after the level adjustment). The pulse is digitally filtered for 133 milliseconds and provided after filtering on A11 pin 5.

To determine pulse duration, a 60 Hz AC RMS signal is provided by a transformer to pin 20 and is utilized as a 16.67 millisecond time cycle reference clock. A8 and A17 generate time pulses to add 1 to time counter A16 at intervals of 750 milliseconds, 1.5 seconds, 2.5 seconds, and 3.5 seconds. The A17 feedback interconnection is changed by multiplexor A18 (count modulo 3 or modulo 4) to obtain increments of 750 milliseconds or 1 second, depending on the A16 time count.

A 1-second time pulse is decoded if the pulse exists from 750 milliseconds to 1.5 seconds. A 2-second time pulse is decoded if the pulse exists from 1.5 to 2.5 seconds, and a 3-second time pulse, from 2.5 to 3.5 seconds. When pulse transition from high to low level occurs, the count in A16 is transferred to A10.

When A16 reaches a time of 3.5 seconds, A5 is enabled and outputs a 10-millisecond pulse on A5 pin 10 if a 1-second pulse was decoded, or on A5 pin 9 if a 2-second pulse was decoded, or on A5 pin 7 if a 3-second pulse was decoded. The 1-second pulse, which energizes/de-energizes the track-side equipment, is output on pin 8 as a pulse.

The 2-second pulse, which arms/disarms the one move cancel logic, is latched on pin 4, and the output changes state on each command. The output is reset by train movement or by power restorations, thereby insuring that the next train movement will be recorded.

The 3-second pulse, which energizes/de-energizes the auxiliary equipment, changes state on each command and is reset to the de-energized state when power is restored.

Figure 11A:
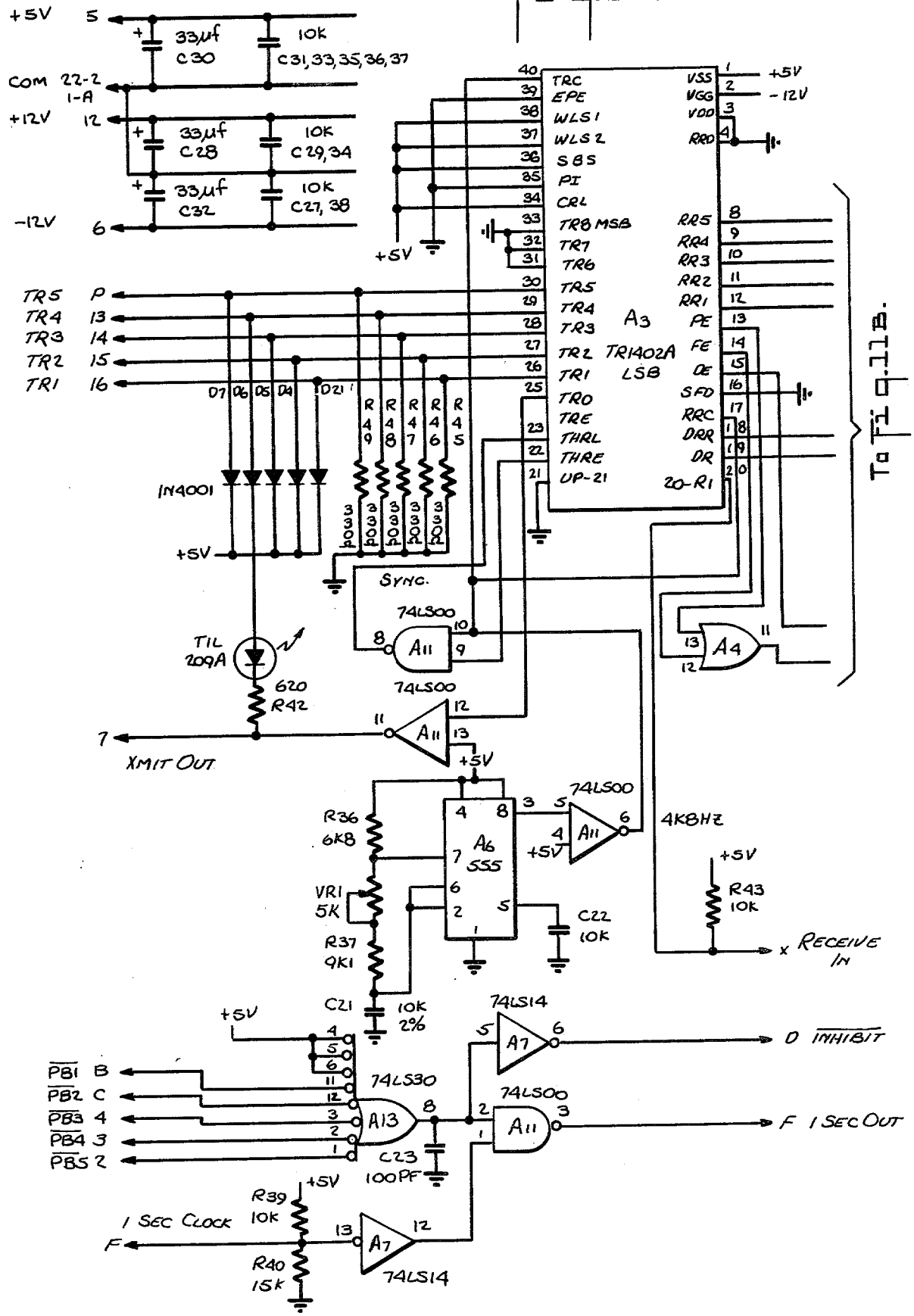
FIGS. 11 (11A and 11B) and 12 are circuit diagrams for a telephone encoder/decoder.
Figure 11B:
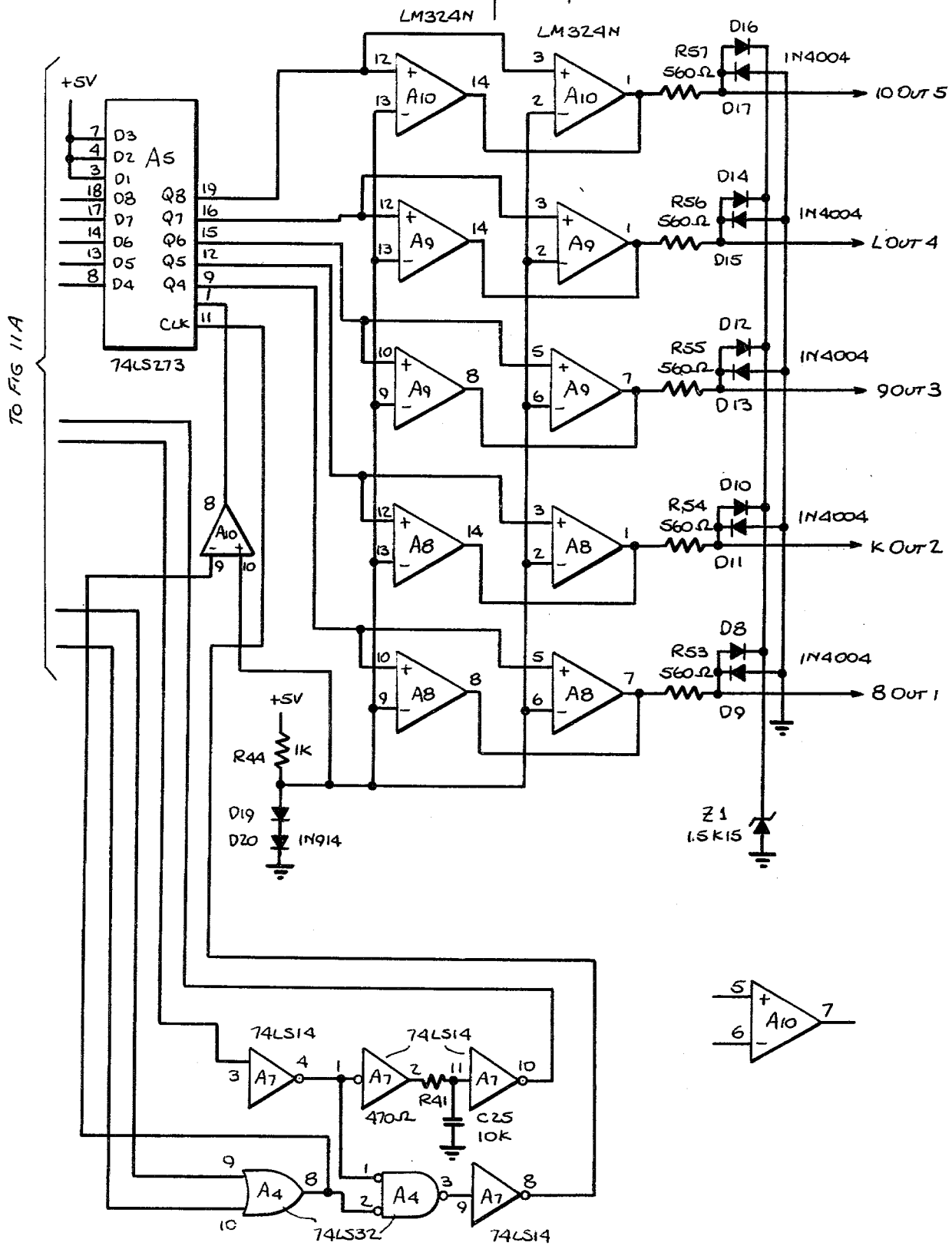
Figure 12:
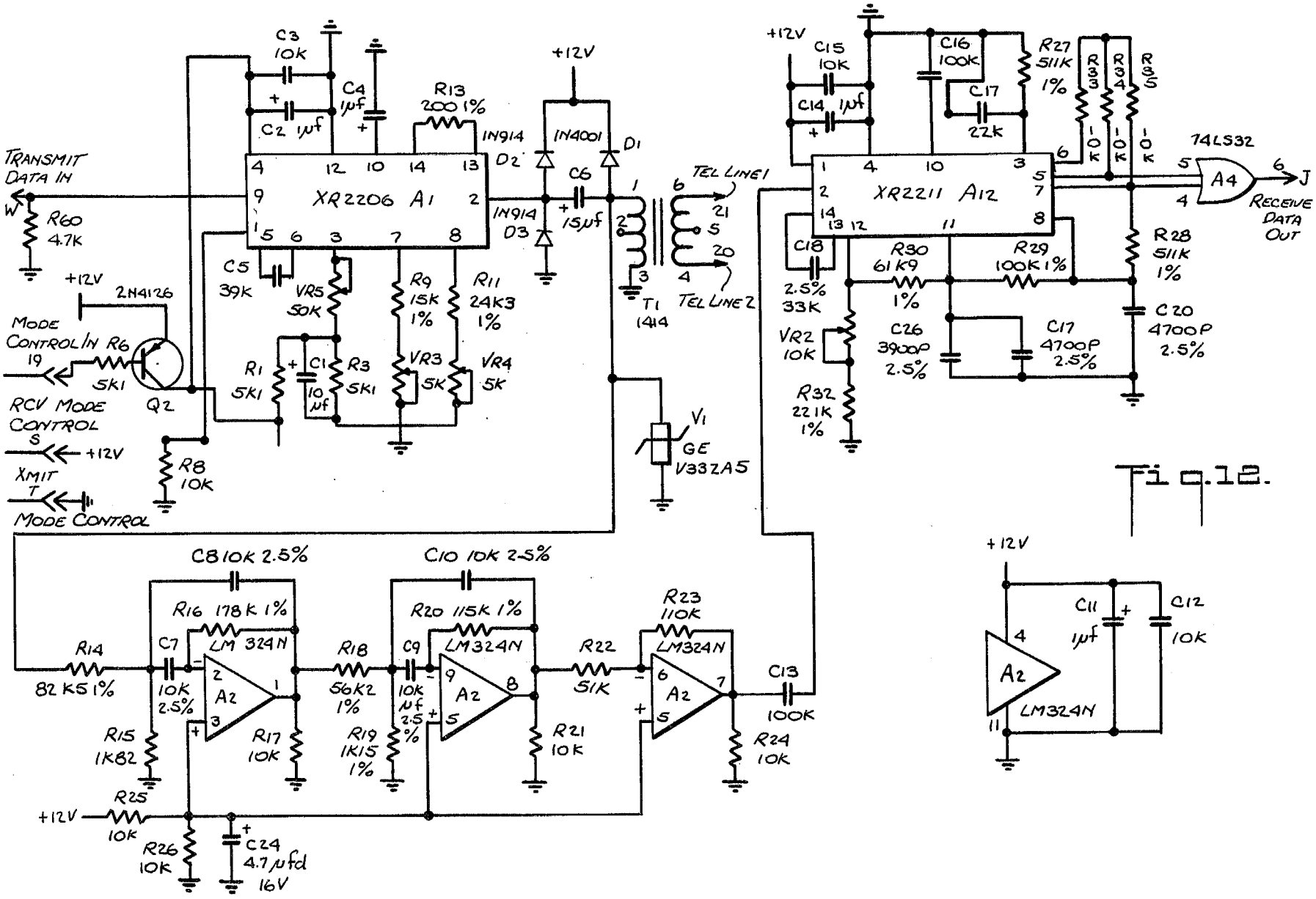

The module of FIGS. 11 and 12 encodes/decodes control signals to the track-side equipment from the remote console when the reverse transmission medium is a telephone line. Standard voice-grade telephone circuits are preferred (AT&T type 3002 or equivalent).

The module performs one of two functions, depending on where installed in the system. If at the console, the unit encodes time pulses generated by the time duration encoder module (FIGS. 17 and 18) for compatibility with telephone line transmission facilities. If at track-side or microwave transmitter site, the unit decodes the telephone-compatible signal and converts it to time pulse levels compatible with the time duration command decoder (FIG. 10).

The module of FIGS. 11 and 12 transmits or receives a 5-bit data word, corresponding to the 5 channels, over a dedicated telephone line. The external connections to the module's board determine the modules use, i.e., whether for transmission or reception.

The input to the transmitter portions of the module and the output of the receiver portion are both single, 5-parallel-bit words. Each bit corresponds to a control channel. The output of the receiver merely duplicates the corresponding input to the transmitter. Transmission is continuous (at 300 baud), using FSK (frequency shift keying) modulation along a telephone line that is electrically isolated from the modules.

A UART (universal asynchronous receiver/transmitter) transmits the data word, which is input with the bits in parallel, and the bits are output serially. A voltage-controlled oscillator produces the FSK signal. Additionally, at track-side, the UART (also used for transmission) changes the serial bit stream into a parallel-bit data word. The serial bit stream consists of 1 start bit, 8 data bits (first 5 utilized, last 3 always low), an odd-party bit, and 2 stop bits.

The data to be transmitted enters the P.C. board through TR1-TR5. The UART (A3) sends the data (in serial form) to the transmit data out pin (pin 7). The signal into pin 23 of A3 strobes new data into the UART whenever the transmitter buffer register of the UART is empty, thus causing the UART to transmit continuously. A6 generates a 4.8 KHz pulse, providing the clock for the UART (both the transmitter and receiver sections) and setting the data rate at 300 baud. The LED is on whenever the transmit data out signal is low.

If the module is used in the transmit mode, then card-edge connector pin 7 (transmit data out) is connected to pin W (transmit data in) and pin 19 (transmit enable) is connected to pin T (GND). This enables tramsission through the telephone line and feeds the output of the UART into the FSK modulator.

If the module is used in the receive mode, the card edge connector pin 19 (transmit enable) is connected to pin S (+12 volts), and pin J (receive data out) is connected to pin X (receive data in). This disables transmission through the telephone line and feeds the output of the FSK demodulator into the UART. The data of the FSK modulator (A1) switches the resistors used for the oscillator between the pair R9/VR3 and the pair R11/VR4. VR3 and VR4 adjust the high (1400 Hz) and low (900 Hz) frequencies, respectively. VR5 adjusts the amplitude of the output to the telephone line.

The telephone line signal received goes into an active filter consisting of A2 (Quad Op-Amp) and the associated components and then to a phase-locked loop (A12) used as a FSK demodulator. VR2 adjusted the center frequency of the VCO of the phase-locked loop. FSK demodulator output is the receive data out signal (card edge connector pin J). The signal at the receive data in terminal (card edge connector pin X) is transformed by the UART into a parallel-bit word and latched into the octal latch (A5). The latched word enters A8, A9, and A10 (Quad Op-Amps), which act as 12-volt logic drivers. The received data output signals are OUT1-OUT5.

Part of the circuitry of FIGS. 11 and 12 (A13, A7, and A11) is not directly related to the telephone line encoding/decoding; it acts with circuitry of other diagrams for sending system commands. The 1-second CLK signal (connector pin F) is a pulse waveform of 1 second cycle time entering the board. The PB1-PB5 inputs are normally at a high logic level. When any one of these inputs is held low, the inhibit signal (connector pin D) goes low and the 1-second signal (connector pin E), normally high, outputs the 1-second clock waveform of the 1-second CLK signal.

The power encoder module (FIG. 13) transmits operator commands to track-side equipment when video signals are RF multiplexed from track-side to the remote operator console. A power decoder module (FIG. 14) decodes the signals near track-side, where they are converted for baseband video bias compatability.

Figure 13A:
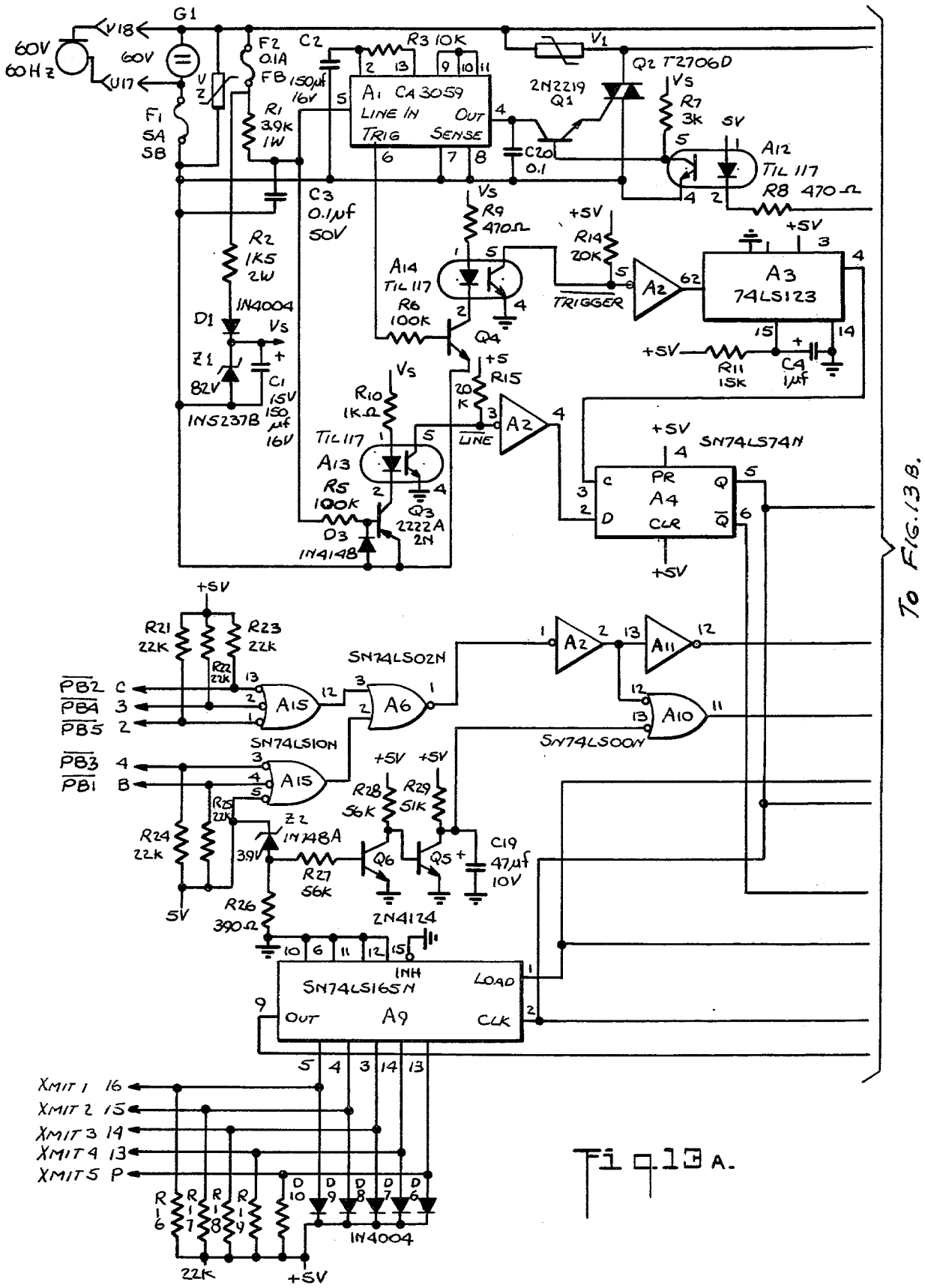
FIG. 13 (13A and 13B) is a circuit diagram for a power encoder.

The module of FIG. 13 multiplexes commands for up to five track-side locations (five channels) by modulating the AC power supplied to the track-side RF amplifiers from the console location. The modulation is obtained by gating off a specific sequence of 60 Hz half cycles. The sequence is chosen to allow operation of peak power supplies without degradation. The encoder can encode nominal 48–72 volt or nominal 24–36 volt RF power lines. (This technique and apparatus therefore are described in the U.S. patent application of Lorne D. O'Connor, Richard Saylor, and Stephen H. Buckser entitled "Power Line Signalling System".)

Normally, the 60 Hz power is unmodulated and unmodified. When a command is transmitted, a sync is generated every 7 cycles by gating off a single positive 180 degree half cycle. When a channel time duration pulse is high (1, 2, or 3 seconds on time), the corresponding negative 180 degree half cycle is gated off continuously. When a channel time duration pulse is low, the corresponding negative 180 degree half cycle is gated on continuously.

Usually, only one channel transmits at any time. This assures that power is transmitted with at least an 85 percent efficiency. When commands are not transmitted (normally quiescent mode), the power waveshape is unmodified, i.e., all half cycles are gated on.

Basic power control is determined by integrated circuit A1 (zero-voltage control circuit), which generates a pulse of triac Q2. This pulse, if passed, gates through the 60 Hz power. The trigger to Q2 is enabled only at zero-voltage time to insure RFI-free switching. When a half cycle is gated off, Q1 is turned off via A12. This prevents the trigger from reaching and firing Q2 on.

Opto isolator A13 determines the polarity of the 60 Hz input, and A1 drives A14 to establish trigger time and step the pulse counting circuits of A5 and A7. When a command is to be encoded, pin B, C, 4, 3, or 2 goes low, which enables A5 and A7 to count. Output pin E generates one pulse per second (actually one per 940 milliseconds) to step the basic time duration encoder synchronously. A8 decodes the count and loads A9 with each channel time duration output. The output is encoded by stepping the shift register with alternate triggers and gating off both Q1 and triac Q2 by enabling opto isolator A12.

To indicate signaling, LED I2 blinks on for every data logic "1" encoded and when a "high" is transmitted by any of the channels.

LED I1 blinks off when 1 second timing pulses are generated, i.e., when any command is transmitted on any channel.

The power decoder module (FIG. 14) is located at track-side and connects to the RF 60 Hz modulated power provided from the console. The module decodes command information encoded on the power line if video is multiplexed to the remote console via RF carrier. The decoder decodes commands for up to 5 trackside locations, which may be near to or remote from the decoder. If remotely located, the decoder and track-side locations are connected via baseband video link. One decoder may service some or all of the track-side locations, or each location may have its own decoder.

The power to be demodulated is input to pins V and Y (polarity is important) and is transformer coupled. A jumper to the appropriate transformer tap selects the proper RMS input voltage range. A1 and C2 act as positive and negative peak detectors, dynamically adjusting for line losses. A2 determines if the voltage is greater than 50 percent of peak voltage, and A5 and A6 require that the level be encoded for 1.7 milliseconds before recognizing a half pulse present.

Absence of "valid+" establishes a sync detection, which resets counter A11 and blinks LED I1 on. Absence of "valid −" establishes channel "high" and resets A13. Absence of "valid −" does not clear A13, which would clear A14. Data is shifted from A14 into shift register A16 and output to storage register A17 six "valid −" pulses after the sync pulse. Dynamic receipt of serial data is displayed on LED I1, which blinks off when a "high" is received.

Figure 14A:
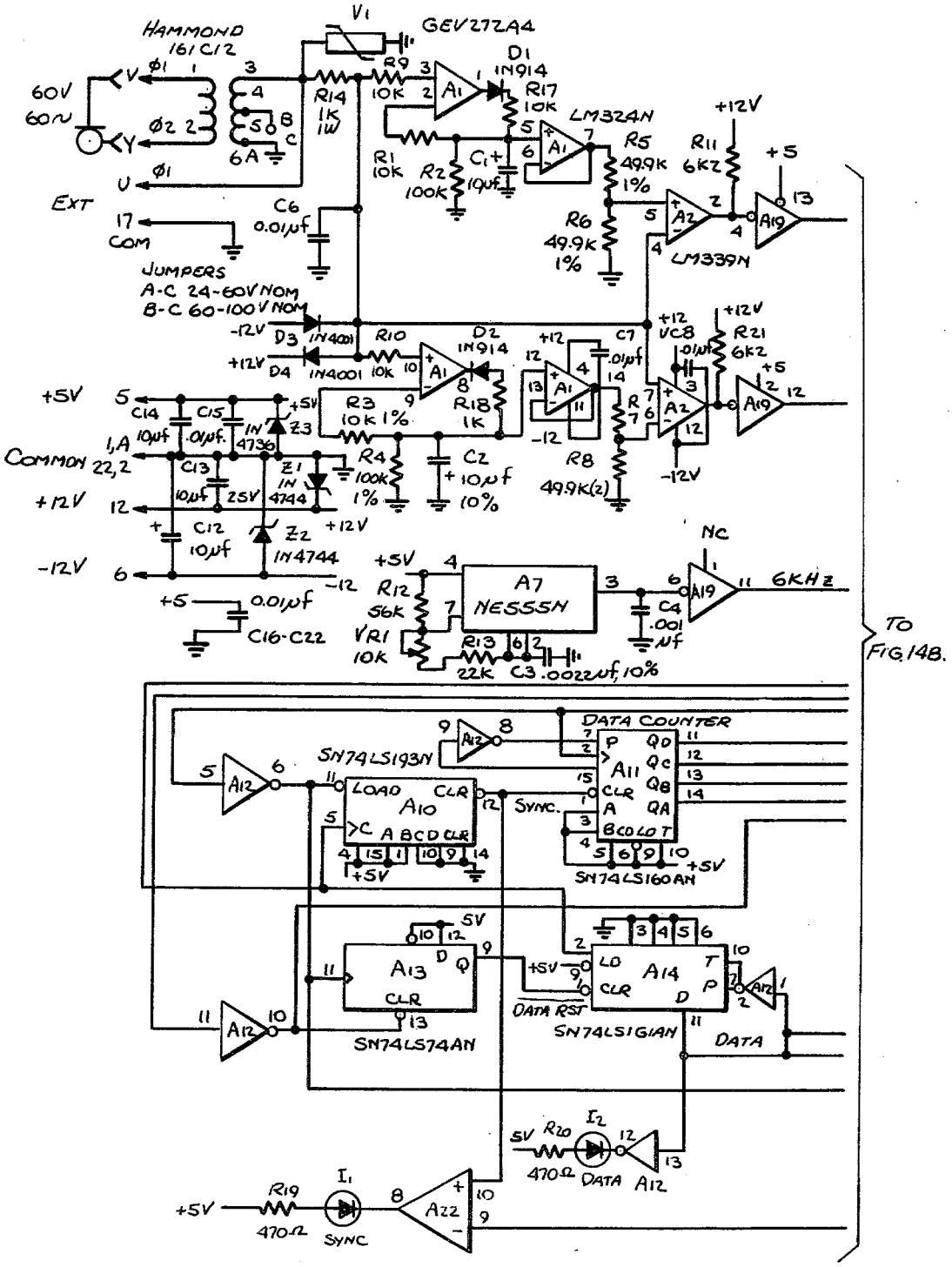
FIG. 14 (14A and 14B) is a circuit diagram for a power decoder.
Figure 14B:
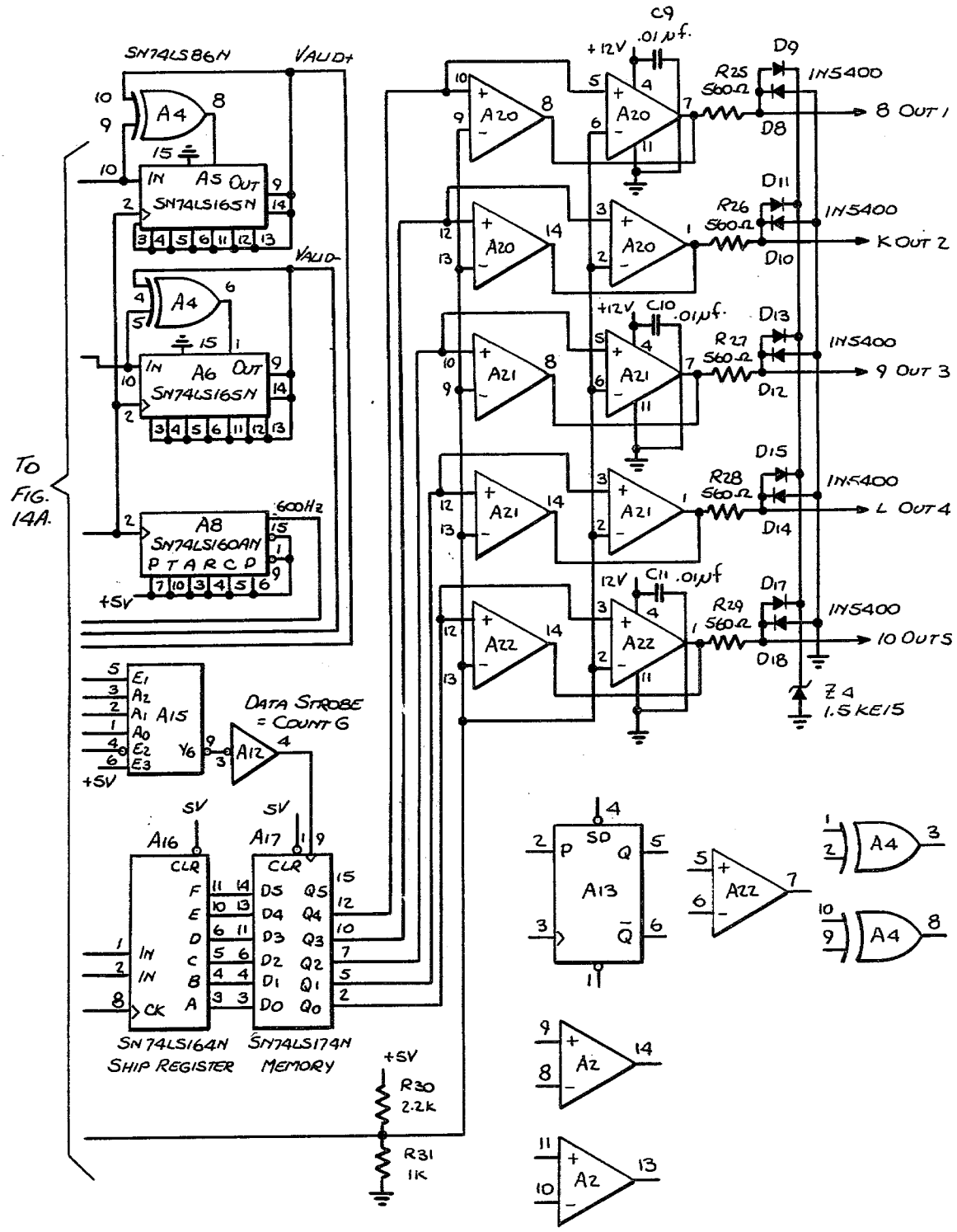
Figure 15A:
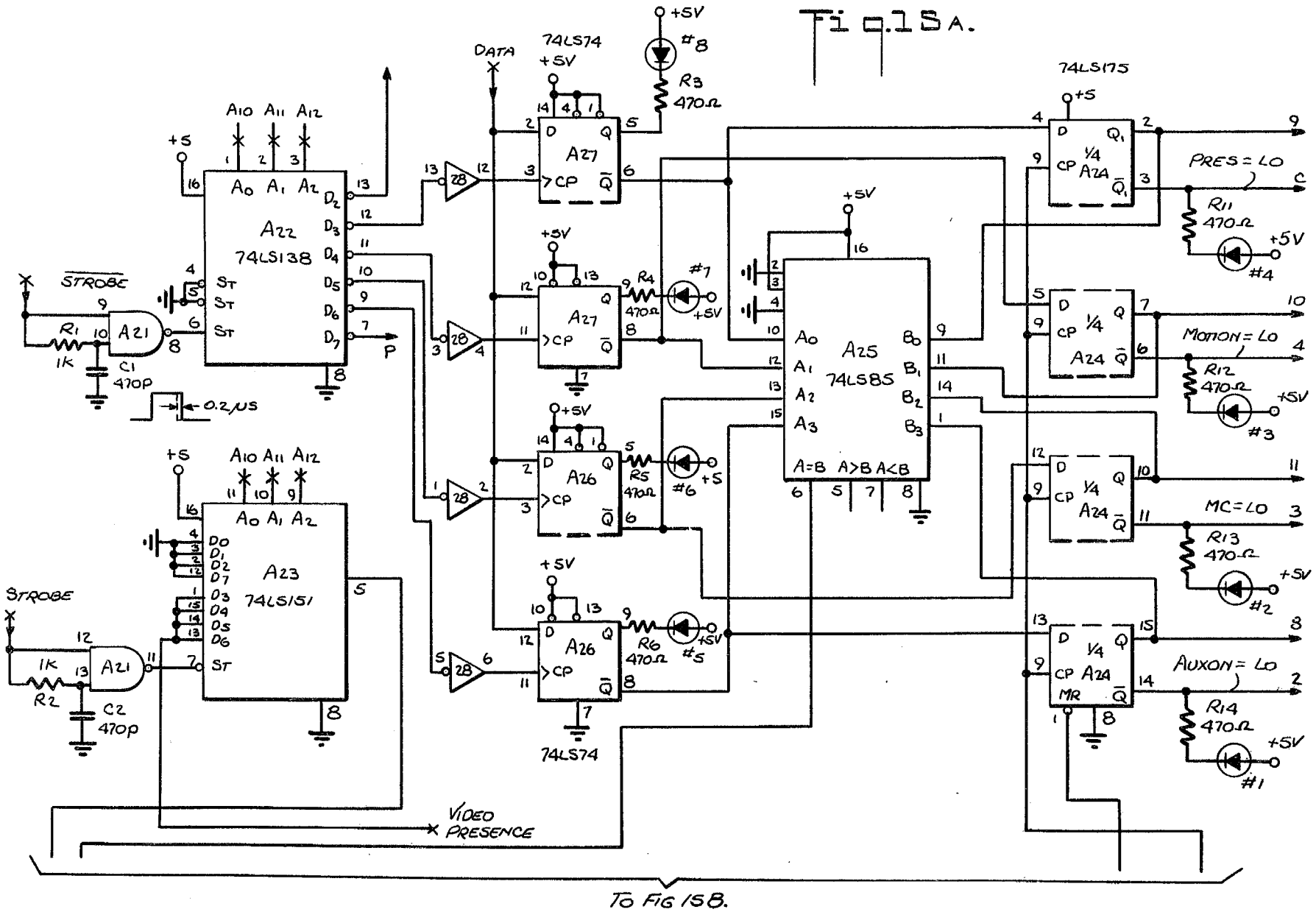
FIG. 15 (15A, 15B, 15C, 15D, and 15E) is a circuit diagram for a V.I.P. decoder.
Figure 15B:
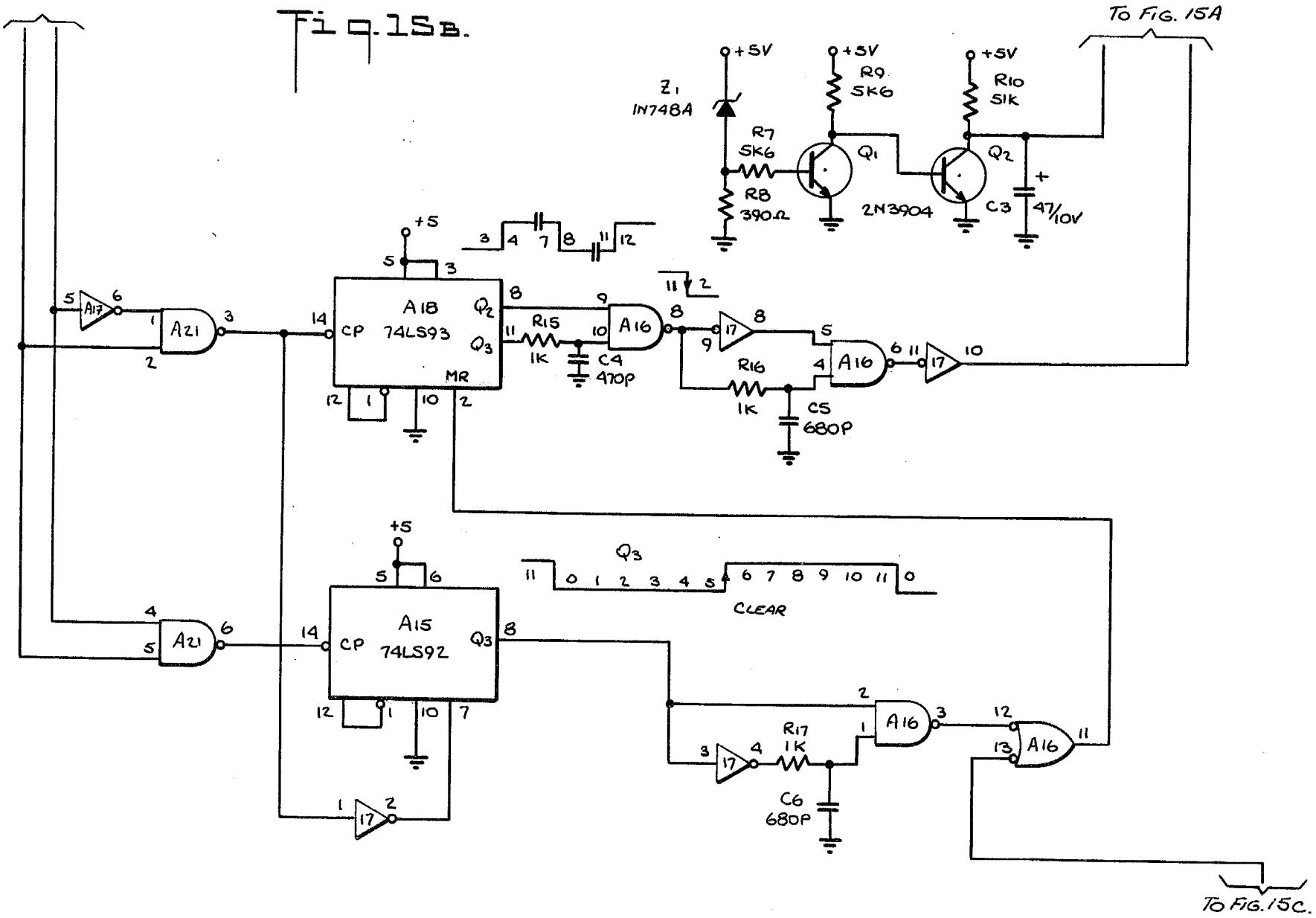
Figure 15C:
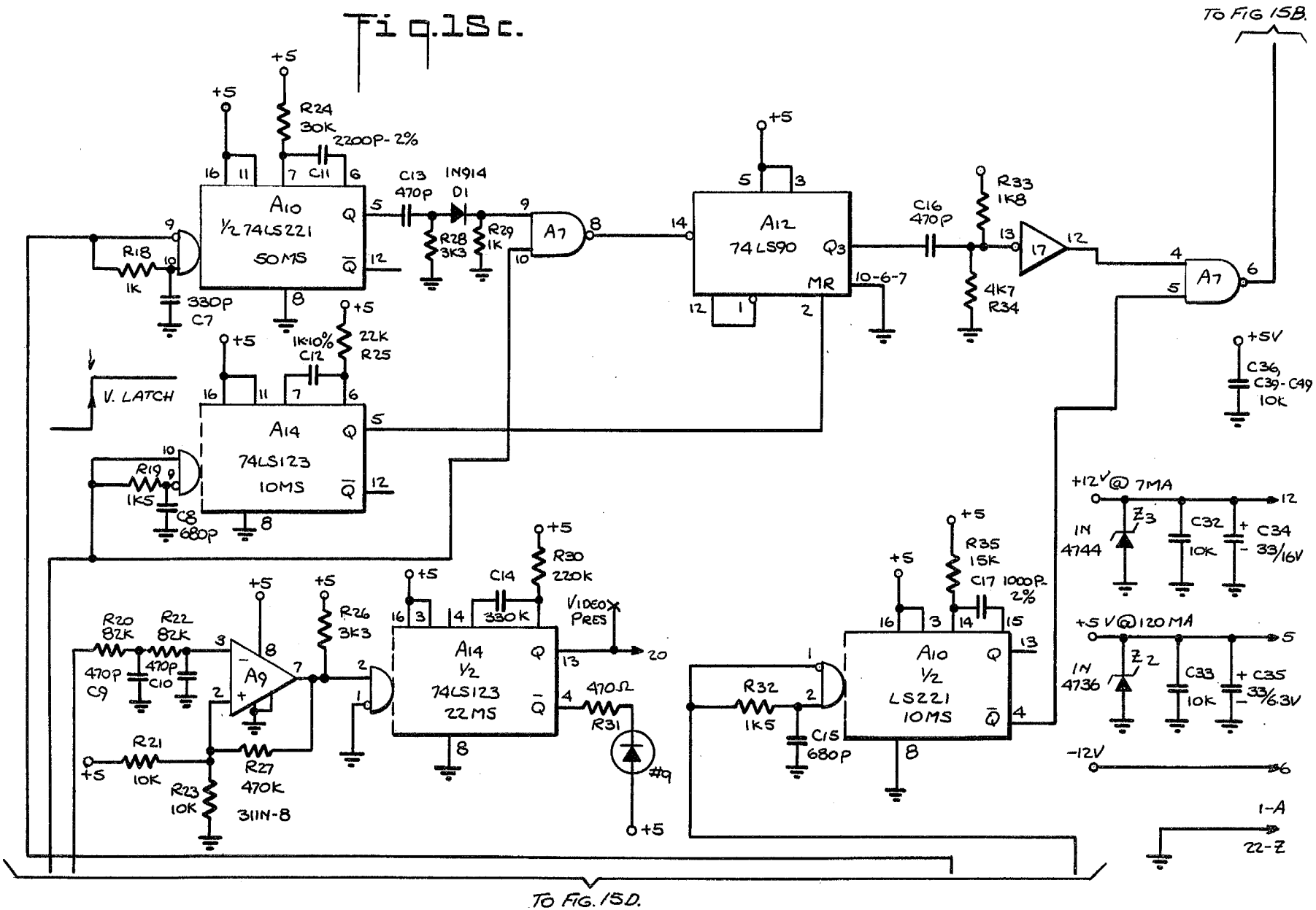
Figure 15D:
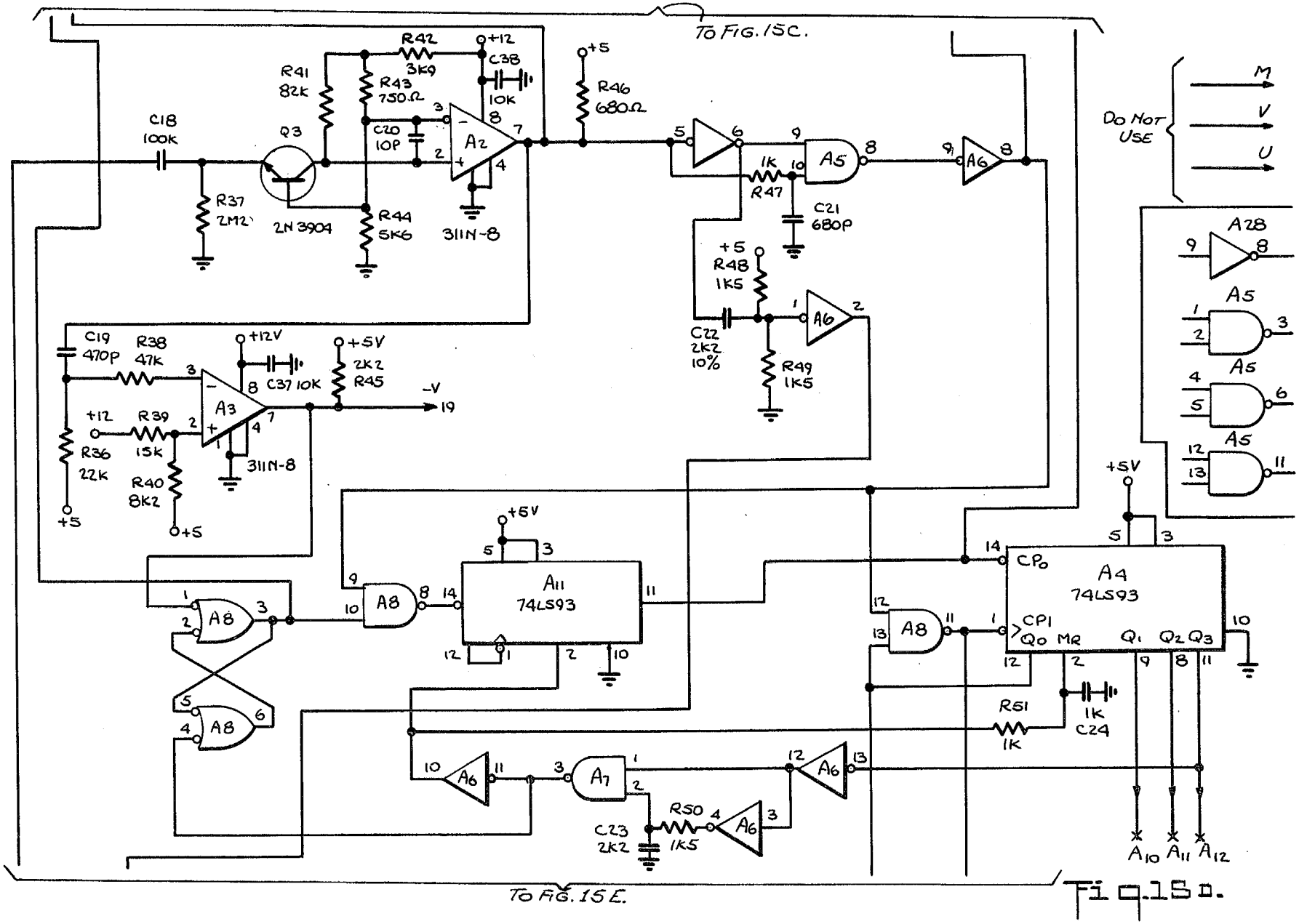
Figure 15E:
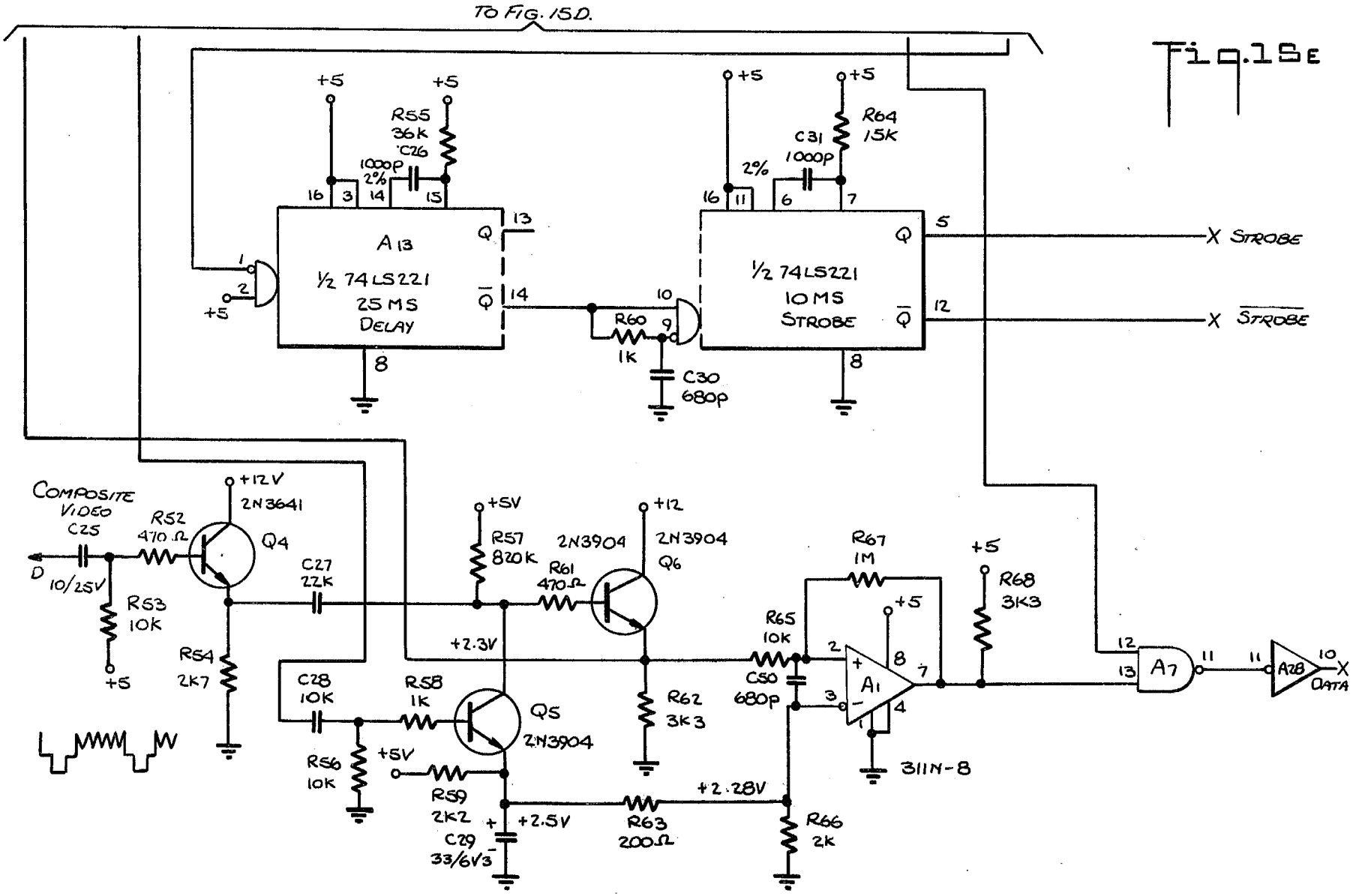
Figure 17A:
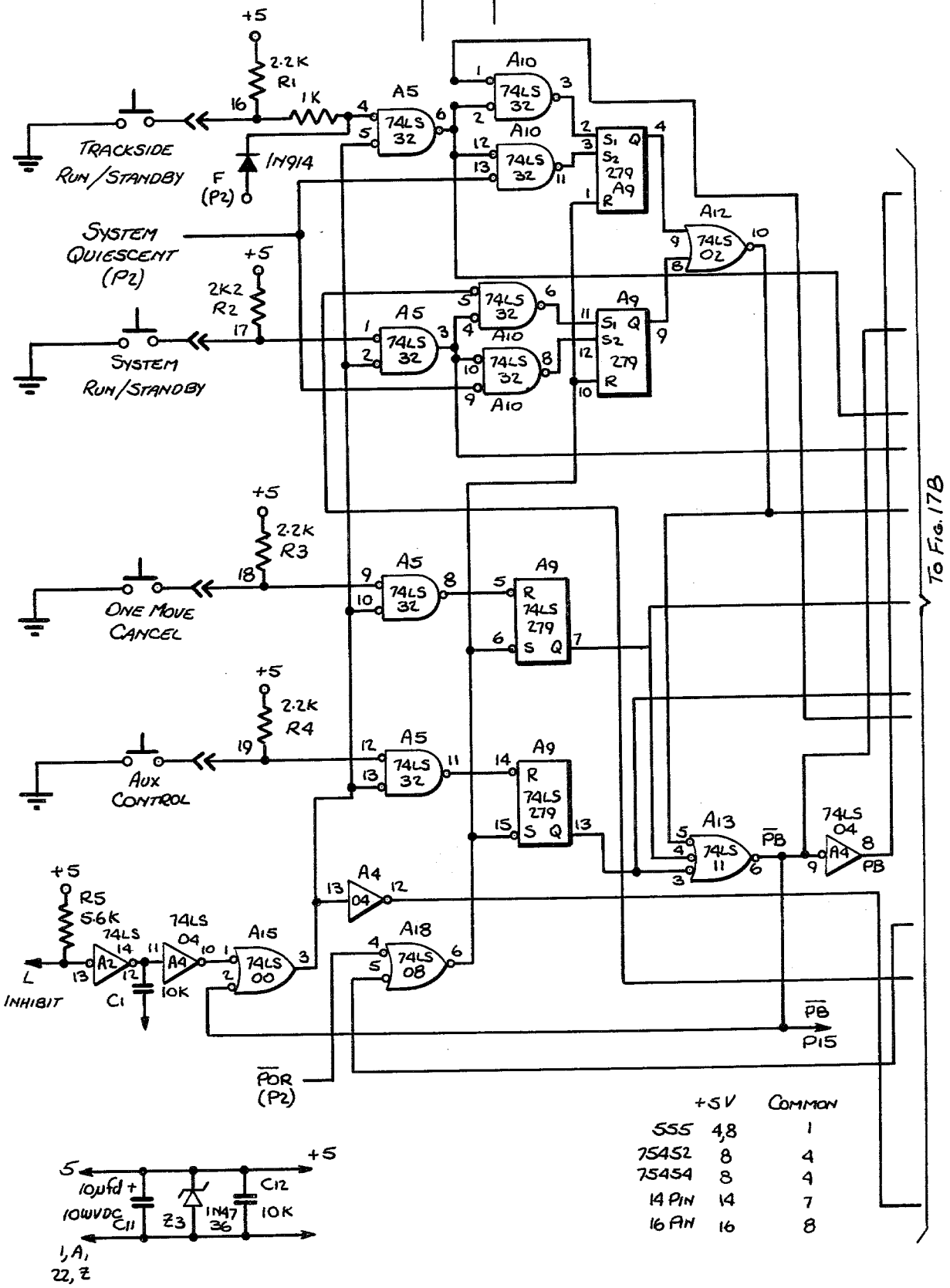
FIG. 17 (17A and 17B) and 18 are circuit diagrams of a remote control and indication time duration encoder module.
Figure 17B:
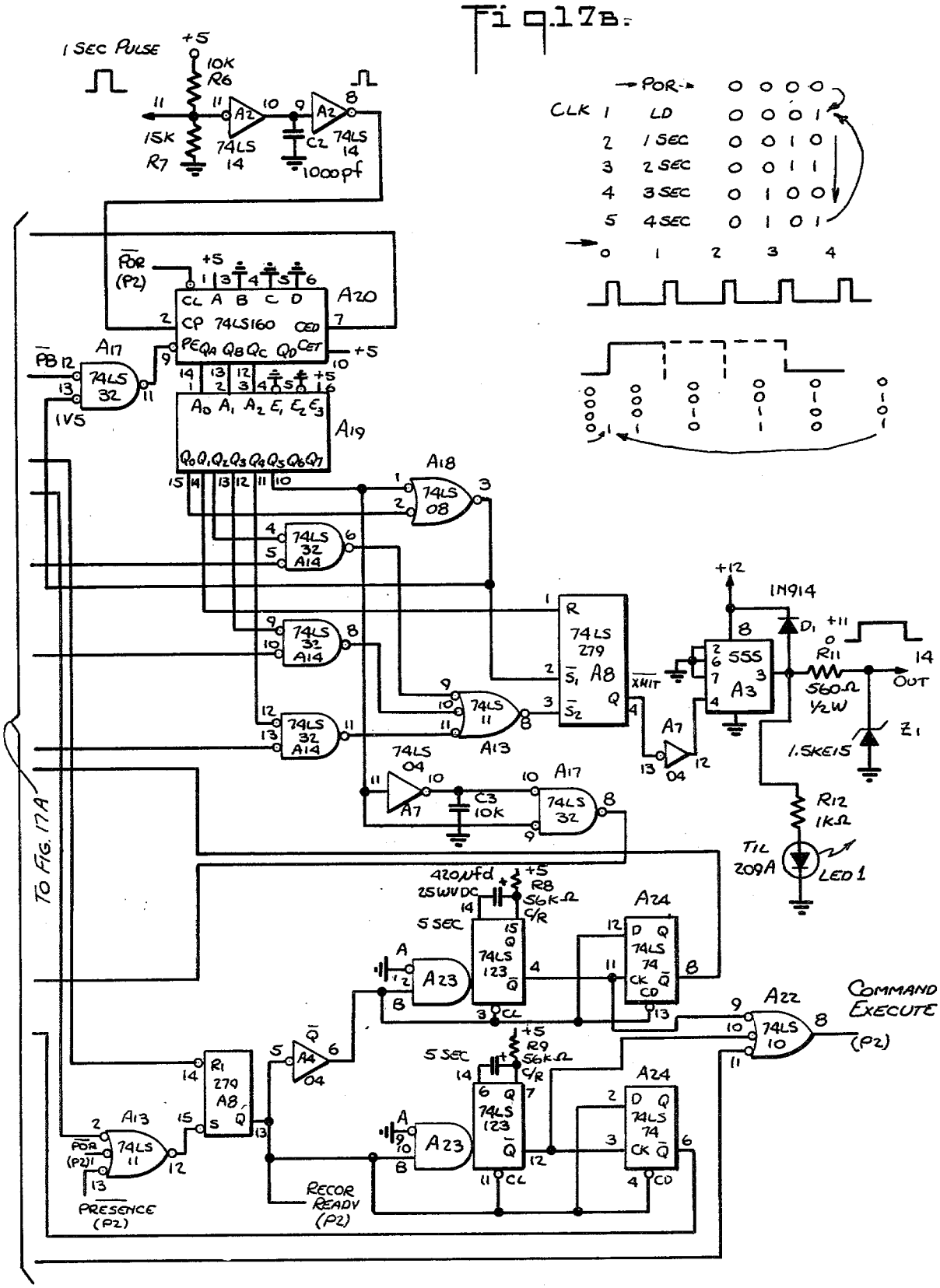
Figure 18:
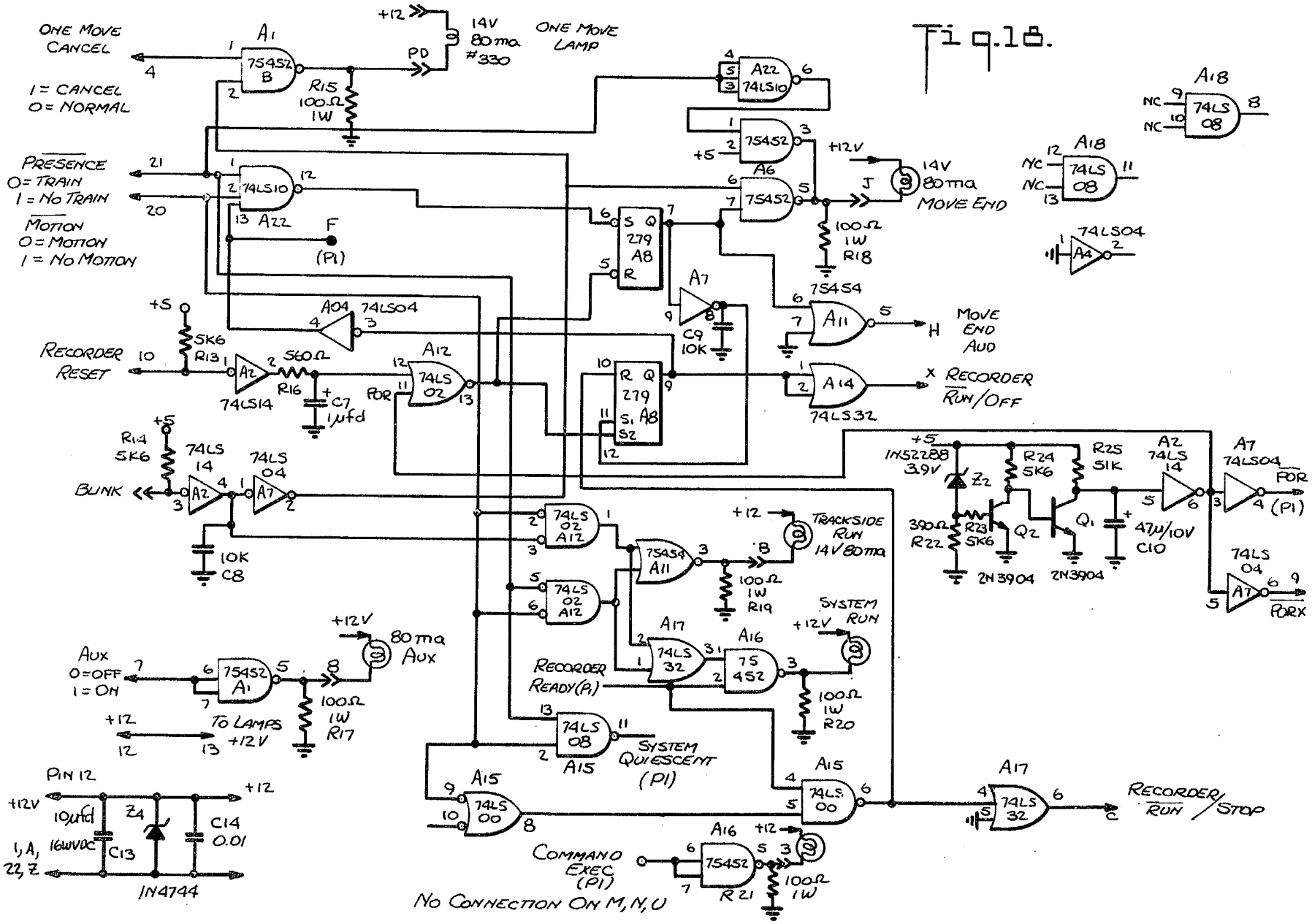

Amplifiers A20, A21, and A22 drive the time duration combiner (FIG. 16) with time duration outputs of identical level, generated at the remote console by the time duration encoder module (FIGS. 17 and 18). The time duration decoder (FIG. 10) may be located adjacent to or remote from the power decoder module (FIG. 14). If remote, they may be connected by coaxial cable, utilizing baseband video transmission.

The vertical interval pulse decoder (FIG. 15) is located at the console, operating on the video signal from track-side to decode status information. That information controls the video recorder and display indicators.

The digital status is transmitted piggyback on the video signal, as described above (text accompanying FIG. 9). The composite video, containing the track-side camera output and the encoded signal (V.I.P. encoder), is connected to pin D and buffered on the emitter of Q6.

The circuit consisting of Q3, A2, and C18 (sync separator) detects every sync pulse. The circuit consisting of C19 and A3 (vertical sync separator) detects only every vertical sync pulse, due to its time constant.

White levels as well as white background on video are detected by A1. The vertical block separator and sync separator synchronize the horizontal lines corresponding to the transmission of the encoded bits. The first detection by the vertical block separator sets latch A8 pin 3 high, enabling counter A11 to count the leading edge of counter A11. After 16 counts, counter A4 is enabled to count. Q1, Q2, and Q3 of A4 correspond to the initial line numbers used to synchronize the row data.

The leading edge of the sync separator output drives A13, which then generates a delayed sampling pulse that samples decoder A22. Decoder A22 outputs D3, D4, D5, and D6, which are enabled to clock A26 or A27, depending on the line count of A4. The data output on A28 pin 10 is strobed every scan, and the strobes are displayed on LED's 5 to 8 to indicate the performance of the video link.

Sync separators are detected on A2 pin 7 and A6 pin 9. If detected for a time greater than 22 milliseconds, A9 and A14 turn LED 9 on to indicate video presence and A14 pin 13 assumes a high logic level.

Multiplexor A23 generates (up to) 4 pulses per vertical retrace. Comparator A24 compares the recent data on A26 and A27 to the previous output data of A24. If the earlier data are equal to the new data, A15 is enabled to count. If unequal, A18 is enabled to count. If A15 counts for six (6) consecutive pulses, counter A18 is reset by counter A15. If the old and new data are unequal for twelve pulses, A16 pin 8 outputs and the new data are strobed in register A24, thus becoming the old data.

The secure data are displayed as follows:

| Secure data | Display |
|---|---|
| Presence | LED 4 on when true |
| Run | LED 3 on when true |
| One Move Cancel | LED 2 on when enabled |
| Auxiliary | LED 1 on when true |

The corresponding outputs are output on pins 8 to 11 to the time duration encoder module (FIGS. 17 and 18). Timer A10 and counter A12 count to assure that the proper number of vertical sync pulses are received. Only when the count minus one-half the number of vertical sync pulses is synchronized with the count of A4 is output memory A24 allowed to update. Disagreement causes A16 pin 11 to reset counter A18, requiring 3 additional frames before update of data is permitted.

The time duration combiner (FIG. 16) adds the time duration command to the coaxial cable baseband video link. The time commands are decoded at track-side and allow the console operator to control the track-side equipment.

The basic time duration pulse is generated by the time duration encoder module at the remote console. If baseband video transmits video from track-side to the console, then the module is connected directly to time encoder module at the console location. If RF or microwave video transmission is utilized, the module is connected to the power decoder or telephone decoder, respectively. The power decoder and telephone decoder duplicate the time encoder pulses generated at the console for compatability if baseband video link is not utilized as a transmission medium for the entire signal transmission link.

The time encoder output (or appropriate channel output of power decoder or telephone decoder module) drives the base of Q1 to energize relay K1. Normally, K1 is de-energized and video from track-side enters on pins 2 and 4 and goes to the monitor and recorder on pins 11 and 13. The circuit provides surge protector for the monitor.

When a compound pulse is generated (caused by an operator depressing a command button), K1 energizes, placing 12 volts and a discharged C3 on the video link. This results in a +2 volt level on the link. The pulse is decoded at the camera site by the time duration decoder. G1 and G2 protect circuitry from surges induced on the video link and automatically clear from circuit operation after the surge has disappeared.

The status of track-side equipment is decoded by the V.I.P. decoder (FIG. 15) and presented in parallel to the remote control and indication time duration encoder module (FIGS. 17 and 18) for display annunciation. The latter module also encodes command signals from the operator to track-side. The encoded signal is then transmitted to track-side by either the time duration combiner (FIG. 16), power encoder (FIG. 13), or telephone encoder (FIGS. 11 and 12).

Presence is asserted low when a train approaches or is within a monitored track section. Motion is asserted low when a train approaches or moves within a monitored track section. Lamps for track-side run, system run, move end, and audible signal (move end audible) operate according to the sequence of operation of the presence and motion signals.

The track-side run lamp is on steadily when motion and presence are both asserted. Track-side run blinks when motion is asserted but presence is not. The blinking condition occurs as a result of an operator request or track-side maintenance test.

System run operates the same way as track-side run if the video recorder controls are enabled. Enablement occurs, for example, if there is a train movement or the operator requests a track-side test by pushing the system run button. However, the system run lamp is off if the operator requests a track-side test by pushing the track-side run button.

The move end lamp goes on steadily as soon as presence is detected. When the train passes the track-side location, the move is over and the latch on A8 pin 7 is set. This resets the latch on A8 pin 9, which results in move end blink via A6 pin 5. Additionally, setting of A8 pin 7 causes a low on pin H. This enables the audible signal to alert the operator of the move end.

A positive motion input causes the recorder run/-standby to run if the recorder is ready. If the videotape has moved from its initial position, the recorder run/-stop is placed in the run mode. Recorder run/stop gates the recorder for long delays, reducing wear on the machine. Recorder run/standby gates the recorder for short delays. It is used if a train stops at track-side, to prevent loss of recordable data when the train starts up again.

The command execute lamp is lit when commands are being processed. When the system is quiescent, command execute is off and the pushbuttons are enabled to accept operator entry of commands (A15 pin 3 is low enabling all A5 gates). If the track-side run/standby button is pushed, latch A9 pin 4 sets A13 pin 6 low and A15 pin 3 high, or if the system run/standby button is pushed, latch A9 pin 9 is set. In either case, command execute lights and prevents acceptance of further commands for 4 seconds, in the following manner.

Counter A20 is enabled and the 1-second pulses on pin 11 cause a 1-second pulse on latch A8 pin 4 and on output pin 14. (Depression of either the one move cancel or auxiliary control button cause a similar sequence of events, except that 2- and 3-second pulses, respectively, are generated on pin 14 instead of the 1-second pulse.) After 4 seconds A17 pin 8 goes low momentarily. This latches A9 and allows acceptance of future commands for execution.

Transmission to track-side is prevented when alternating track-side run and system run commands are entered. This allows the operator to change from track-side run to system run (i.e., turn on the recorder), and vice versa, without terminating track-side operation.

If buttons are depressed simultaneously, the shorter pulse is generated because A14 pins 6, 8, and 11 operate on latch A8 pin 4 on a first-come basis and the common time counter starts at a count of 0 seconds.

The 1-, 2-, or 3-second pulse is integrated into the video bias. Alternatively, the pulse may be sent multiplexed by reverse RF power supply modulation or by telephone line FSK modulation. The basic pulse is then decoded, or demodulated and decoded, at track-side. An inhibit input pin (pin 2) allows only one command to be sent on the reverse power supply multiplexors at a given moment.

Figure 19:
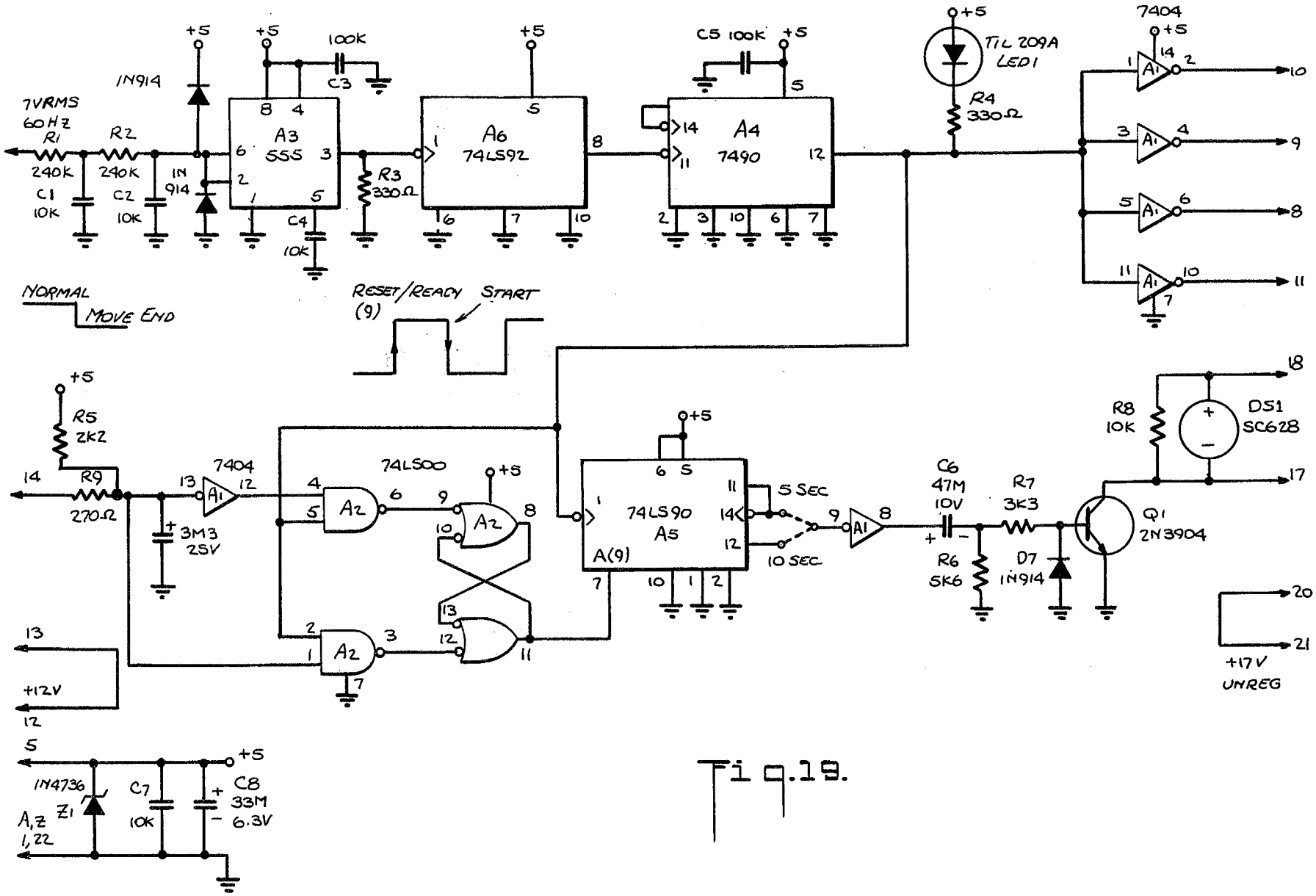
FIG. 19 is a circuit diagram for a 1 Hz clock and audible signal module.

The clock and audible module (FIG. 19) drives the audible alarm after a train move is complete and the videotape is available for playback. The module also generates a timing signal that is used (a) to generate the time duration pulses for transmission of command and (b) for control of indicator lamp blinking.

A 7 VAC rms signal is received on pin 7 and converted to a square wave 60 Hz signal output on A3 pin 3. The signal is counted down by A6 and A4 to provide a 500 millisecond high and 500 millisecond low on pins 8, 9, 10, and 11. These outputs drive the blink and timer inputs of the time duration encoder (FIGS. 17 and 18) either directly, or indirectly via the telephone encoder module (FIGS. 11 and 12).

When a move end occurs, a low logic level is input to pin 14. This sets the latch and removes the reset for the divide-by-10 counter (A5). A jumper is inserted to provide a momentary sound either every 5 or 10 seconds.

Removal of the tape from the video recorder removes the low logic input. This resets the counter and turns the sound drive off.

Figure 20:
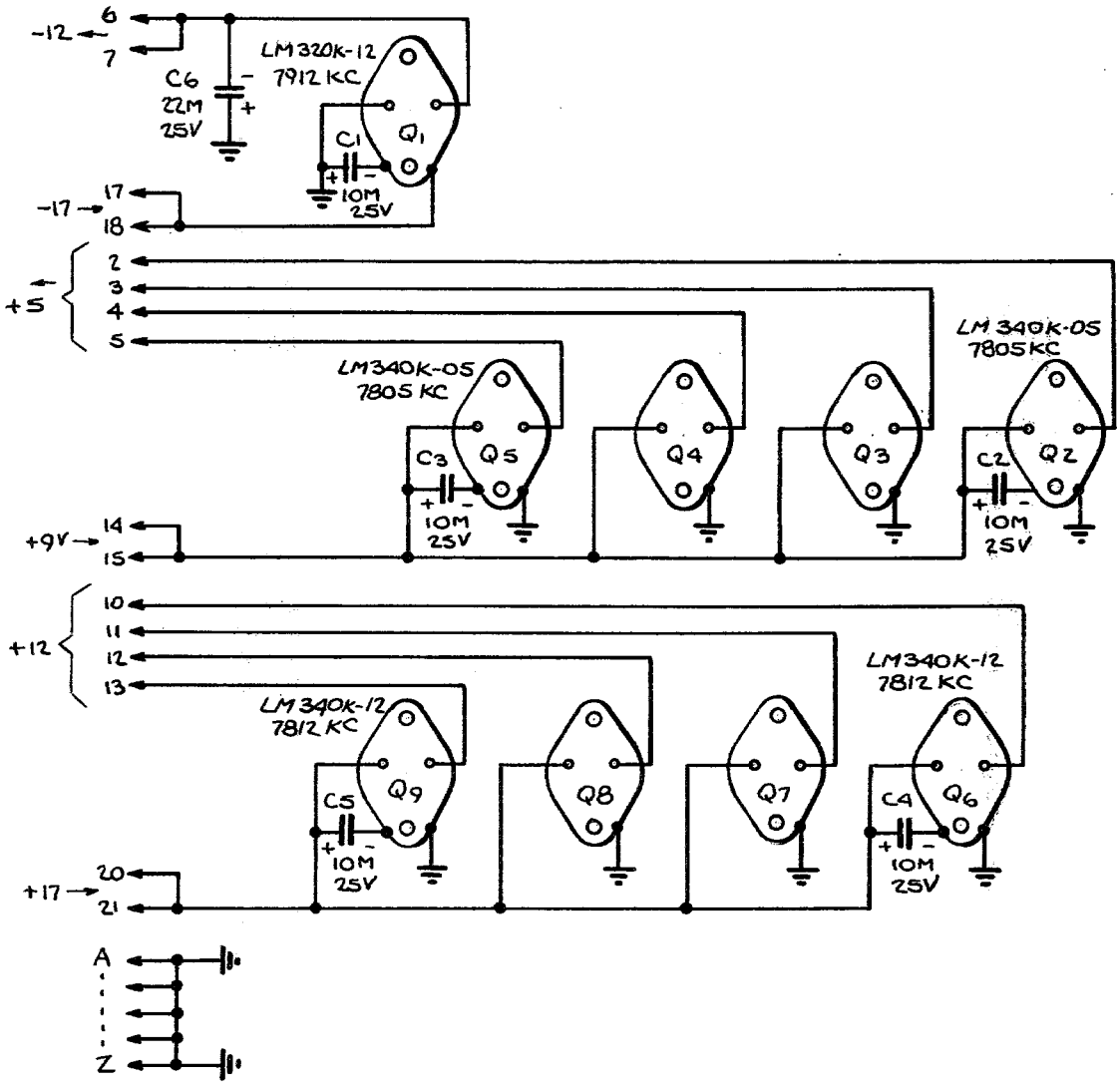
FIG. 20 is a circuit diagram for a supply regulator.

The supply regulator module (FIG. 20) provides +5 VDC, +12 VDC, and −12 VDC, which power the other logic modules. Four separate +5 VDC series regulators provide four individual +5 VDC power outputs for digital logic and other circuits. Four separate +12 VDC series regulators provide four individual +12 VDC power outputs for linear circuitry, lamps, relays, and other circuits. One −12 VDC series regulator provides power for analog and other circuits.

Each regulator can handle a 1-ampere draw. Pre-regulator DC is obtained by full-wave rectification and capacitor filtering of an AC source.

Figure 21A:
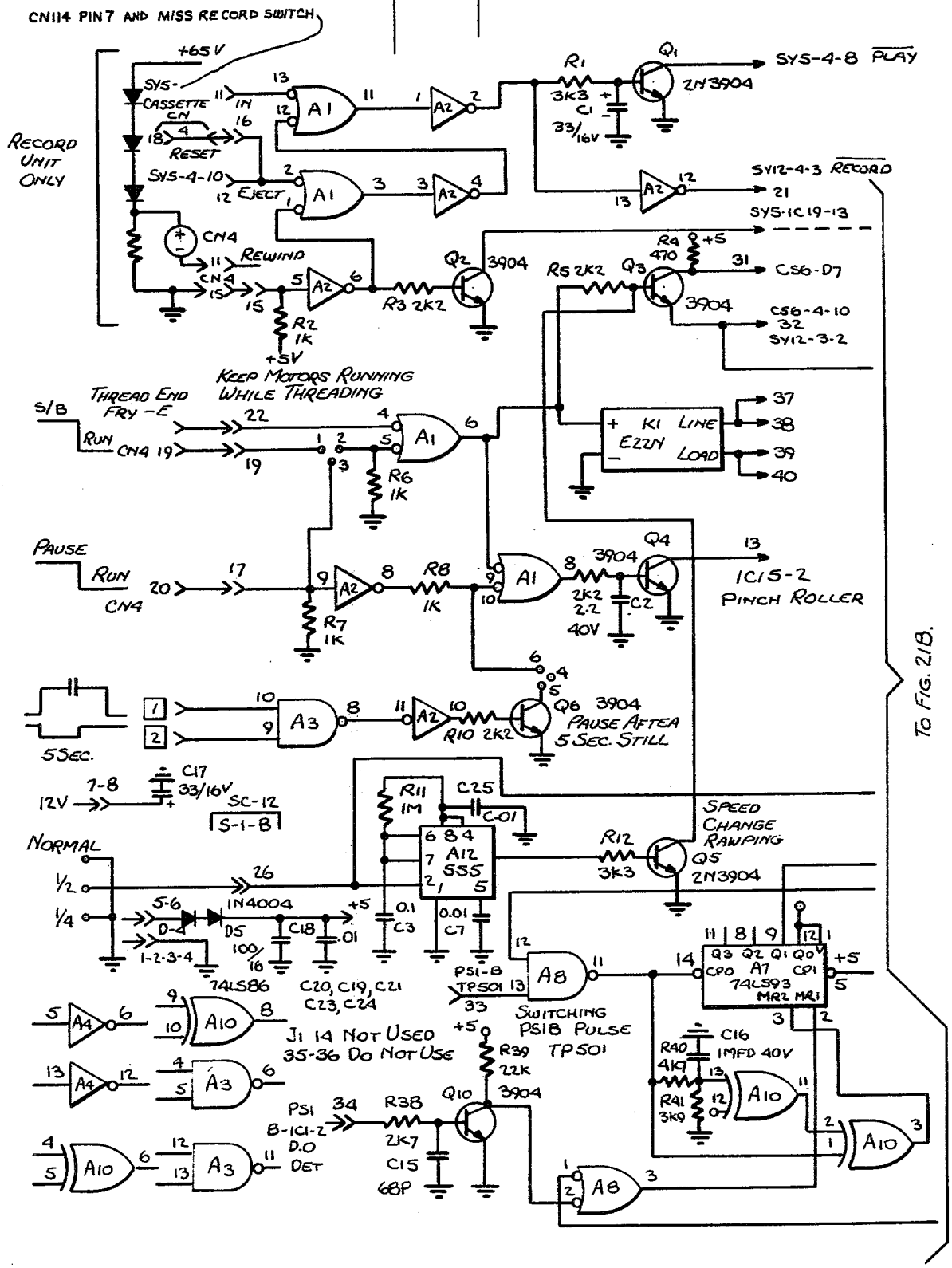
FIG. 21 (21A and 21B) is a circuit diagram of modifications to the preferred videotape recorder.
Figure 21B:
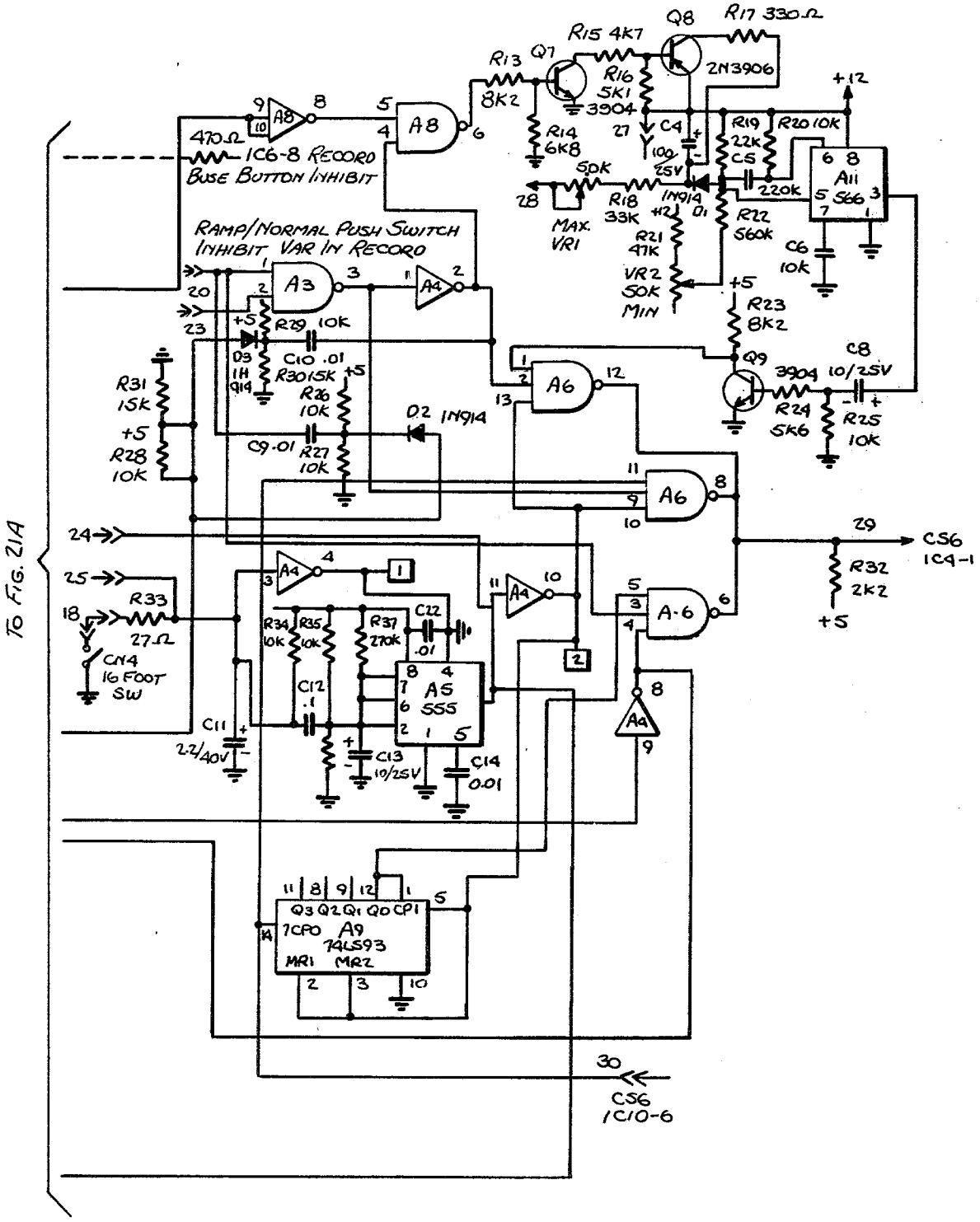

The new circuitry incorporated into each Sony TVO9000 used in this embodiment is shown in FIG. 21. (A schematic of the standard circuitry is known or available to those skilled in the art.) The modifications made improve the unit's performance, increase its reliability, and reduce operator tasks.

The modified unit is self-threading, and removal of the tape cassette automatically resets the move end annunciator. The modified unit has its own standby mode (i.e. independent of reading unit standby), and the recorder's standby and normal recording modes are remote controlled. The recorder goes into standby when a train stops in front of the reading unit, thus insuring that recording will recommence as soon as possible after the train starts to move again. This minimizes loss of data.

Playback/record speeds have been changed from normal, 1/12, 1/24, 1/36, 1/48, and 1/96 to a more useful range of normal, $\frac{1}{2}$, $\frac{1}{4}$, $\frac{1}{8}$, 1/12, and 1/16. Additionally, a single setting allowing continuously variable playback speeds of 10 to 100 percent of normal has been added.

A frame-freezing mode has been added. Frame-freezing on playback is limited to 5 seconds to prevent tape deterioration. When a freeze is requested, the unit automatically advances the tape if necessary to eliminate cross-over noise.

Variations in and modifications to the system described above will be apparent to those skilled in the art. The claims are intended to cover all such modifications and variations as fall within the true spirit and scope of the invention.

We claim:

1. A system to facilitate comprehension by a human operator at a remote location of identifying data on the railroad cars of a train moving past a fixed point at a track-side location, said system comprising:

(a) a reading unit at the track-side location, said unit producing a video signal containing video information regarding the railroad cars and which unit when enabled may be in standby or run mode, said unit comprising:

(1) a television-type camera which shoots the moving cars, said camera having a pick-up device with high resolution whose retention is not greater than approximately 10 percent after 16 milliseconds;

(2) an optical sampler comprising a disc with a cut-out; and (3) means to rotate the disc cut-out synchronized and phased with the vertical scanning rate of the reading unit when the reading unit is in run mode;

(b) means to record the video information at the remote location;

(c) means to transmit the video information to the record means;

(d) means for playback of the video information at a speed selected by the human operator;

(e) means to sense the approach of a train towards the reading unit and means to sense that the train has passed the reading unit;

(f) means to put the reading unit into run mode after the approach of a train is sensed and means to put the reading unit into standby mode after the train has passed the reading unit;

(g) means to activate the record means to record the video information when the reading unit enters run mode and means to stop the record means when the reading unit enters standby mode; and (h) means to temporarily halt recording if a train stops in front of the reading unit, whereby recording can recommence immediately after the train starts to move again.

2. The system of claim 1 wherein the pick-up device employs lead oxide.

3. The system of claim 1 wherein the camera is a black-and-white camera having a panchromatic spectral response close to that of the human eye.

4. The system of claim 1 further comprising means to encode information regarding the status of the track-side equipment onto the video signal.

5. The system of claim 1 further comprising artificial lighting and means to turn the lighting on to illuminate the railroad car being shot by the camera if the ambient light is too low.

6. The system of claim 1 further comprising means to put the reading unit into run mode from the remote location without causing recording to start.

7. The system of claim 1 wherein the means used to rotate the optical sampler disc comprises a motor chosen from the group consisting of pulse and variable reluctance motors.

8. The system of claim 1 wherein the playback means is chosen from the group consisting of videotape and disc units that allow extended viewing of a particular scene during playback without picture break-up.

9. The system of claim 1 further comprising means to blank the pick-up device when the reading unit enters standby mode.

10. A system to facilitate comprehension by a human operator at a remote location of identifying data on the railroad cars of a train moving past a fixed point at a track-side location, said system comprising:

(a) a reading unit at the track-side location, said unit having a panchromatic spectral response and producing a video signal containing video information regarding the railroad cars and which unit when enabled may be in standby or run mode, said unit comprising:

(1) a black-and-white television-type camera which shoots the moving cars, said camera having a pick-up device with high resolution whose retention is not greater than approximately 10 percent after 16 milliseconds;

(2) an optical sampler comprising a disc with a cut-out;

(3) means to rotate the disc cut-out synchronized and phased with the vertical scanning rate of the reading unit when the reading unit is in run mode; and (4) means to blank the pick-up device when the reading unit is in standby mode;

(b) means to record the video information at the remote location;

(c) means to transmit a signal containing the video information to the record means;

(d) means for playback of the video information at a speed selected by the human operator;

(e) means to sense the approach of a train towards the reading unit and means to sense that the train has passed the reading unit;

(f) means to put the reading unit into run mode after the approach of a train is sensed and means to put the reading unit into standby mode after the train has passed the reading unit;

(g) means to activate the record means to record the video information when the reading unit enters run mode and means to stop the record means when the reading unit enters standby mode;

(h) means to temporarily halt recording if a train stops in front of the reading unit; and (i) artificial lighting and means to turn the lighting on to illuminate the railroad cars being shot by the camera if the ambient light is too low.

11. The system of claim 10 wherein the pick-up device employs lead oxide.

12. The system of claim 10 wherein the pick-up device is a silicon diode array and an infrared-cutting filter is employed.

13. The system of claim 10 further comprising means to put the reading unit into run mode from the remote location without causing recording to start.

14. The system of claim 10 wherein the means used to rotate the optical sampler disc comprises a motor chosen from the group consisting of pulse and variable reluctance motors.

15. The system of claim 10 wherein the playback means is chosen from the group consisting of videotape and disc units that allow extended viewing of a particular scene during playback without picture break-up.

16. The system of claim 10 further comprising means to encode information regarding the status of the track-side equipment onto the signal transmitted to the record means and means to decode and display the information at the remote location.

17. A system to facilitate comprehension by a human operator at a remote location of identifying data on the railroad cars of a train moving past a fixed point at a track-side location, said system comprising:

(a) a reading unit at the track-side location, said unit producing a video signal containing video information regarding the railroad cars and which unit when enabled may be in standby or run mode, said unit comprising:

(1) a television-type camera which shoots the moving cars, said camera having a pick-up device with high resolution whose retention is not greater than approximately 10 percent after 16 milliseconds;

(2) an optical sampler comprising a disc with a cut-out; and (3) means to rotate the disc cut-out synchronized and phased with the vertical scanning rate of the reading unit when the reading unit is in run mode;

(b) means to record the video information at the remote location;

(c) means to transmit a signal containing the video information to the record means;

(d) means for playback of the video information at a speed selected by the human operator;

(e) means to sense the approach of a train towards the reading unit and means to sense that the train has passed the reading unit;

(f) means to put the reading unit into run mode after the approach of a train is sensed and means to put the reading unit into standby mode after the train has passed the reading unit;

(g) means to activate the record means to record the video information when the reading unit enters run mode and means to stop the record means when the reading unit enters standby mode;

(h) means to temporarily halt recording if a train stops in front of the reading unit;

(i) artificial lighting and means to turn the lighting on to illuminate the railroad cars being shot by the camera if the ambient light is too low;

(j) means to encode information regarding the status of the track-side equipment onto the signal transmitted to the record means and means to decode and display the information at the remote location; and (k) means to put the reading unit into run mode from the remote location without turning the record means on.

18. The system of claim 17 wherein the pick-up device employs lead oxide.

19. The system of claim 17 further comprising means to arm the reading unit from the remote location so that the reading unit does not shoot the next train to pass it.

20. The system of claim 17 wherein the pick-up device employs lead oxide.

21. The system of claim 17 wherein the record means is a videotape recorder that allows extended viewing of a particular scene without picture break-up.

22. A process for identifying at a remote location the railroad cars of a train moving past a fixed point at a track-side location, said process comprising:

(a) providing a reading unit at the track-side location, said unit having a panchromatic spectral response and producing a video signal containing video information regarding the railroad cars and which unit when enabled may be in standby or run mode, said unit comprising:

(1) a television-type camera having a pick-up device with high resolution whose retention is not greater than approximately 10 percent after 16 milliseconds;

(2) an optical sampler comprising a disc with a cut-out;

(3) means to rotate the disc cut-out synchronized and phased with the vertical scanning rate of the reading unit when the reading unit is in run mode; and (4) means to blank the pick-up device when the reading unit is in standby mode;

(b) providing means to record the video information at the remote location;

(c) sensing the approach of a train towards the reading unit and sensing that the train has passed the reading unit;

(d) putting the reading unit into run mode after the approach of a train is sensed and putting the reading unit into standby mode after the train has passed the reading unit;

(e) transmitting a signal containing the video information to the record means;

(f) recording the video information using the record means when the reading unit enters run mode and stopping recording when the reading unit enters standby mode;

(g) temporarily halting recording if a train stops in front of the reading unit;

(h) artificially illuminating the railroad cars being shot by the camera if the ambient light is too low; and (i) playing back the video information.

23. The process of claim 22 wherein the camera is a black-and-white type.

24. The process of claim 22 further comprising encoding status information regarding the reading unit onto the signal containing the video information and decoding the status information at the remote location.

25. A system to facilitate comprehension by a human operator at a remote location of identifying data on the railroad cars of a train moving past a fixed point at a track-side location, said system comprising:

(a) a reading unit at the track-side location, said unit producing a video signal containing video information regarding the train and comprising:

(1) a television-type camera which shoots the moving cars, said camera having a pick-up device with high resolution and low lag; and (2) an optical sampler synchronized and phased with the vertical scanning rate of the reading unit;

(b) means to record the video information at the remote location;

(c) means to transmit the video information to the record means;

(d) means for playback of the video information; at a speed selected by the human operator; and (e) means to temporarily halt recording if a train stops in front of the reading unit, whereby recording can recommence immediately after the train starts to move again.

26. The system of claim 25 wherein the camera is a black-and-white camera having a panchromatic spectral response close to that of the human eye.

27. The system of claim 25 further comprising means to encode information regarding the status of the track-side equipment onto the video signal.

28. The system of claim 25 wherein the playback means allows extended viewing of a particular scene during playback without picture break-up.

29. A system to facilitate comprehension by a human operator at a remote location of identifying data on the railroad cars of a train moving past a fixed point at a track-side location, said system comprising:

(a) a reading unit at the track-side location, said unit producing a signal containing video information regarding the train and comprising:

(1) a television-type camera which shoots the moving cars, said camera having a pick-up device with high resolution and low lag; and (2) an optical sampler synchronized and phased with the vertical scanning rate of the reading unit;

(b) means to record the video information at the remote location;

(c) means to transmit a signal containing the video information to the record means;

(d) means for playback of the video information at a speed selected by the human operator; and (e) means to encode information regarding the status of the track-side equipment onto the signal sent to the remote location.

30. The system of claim 29 wherein the playback means allows extended viewing of a particular scene during playback without picture break-up.

* * * * *